US009127903B2

(12) United States Patent
Kresser et al.

(10) Patent No.: US 9,127,903 B2
(45) Date of Patent: Sep. 8, 2015

(54) BODY CONTOURED HANDGUN

(71) Applicant: Taurus International Manufacturing Inc., Miami, FL (US)

(72) Inventors: Mark Kresser, Miramar, FL (US); Marcelo de Albuquerque Knorst, Porto Alegre (BR); Leonardo Brum Sesti, Porto Alegre (BR)

(73) Assignee: Taurus International Manufacturing, Inc., Miami, FL (US)

( * ) Notice: Subject to any disclaimer, the term of this patent is extended or adjusted under 35 U.S.C. 154(b) by 0 days.

(21) Appl. No.: 14/257,183

(22) Filed: Apr. 21, 2014

(65) Prior Publication Data

US 2014/0283426 A1 Sep. 25, 2014

Related U.S. Application Data

(63) Continuation of application No. 13/739,597, filed on Jan. 11, 2013, now Pat. No. 8,752,322, which is a continuation-in-part of application No. 29/410,969, filed on Jan. 13, 2012, now Pat. No. Des. 687,505.

(60) Provisional application No. 61/586,974, filed on Jan. 16, 2012.

(51) Int. Cl.

| | |
|---|---|
| ***F41C 23/10*** | (2006.01) |
| ***F41C 3/00*** | (2006.01) |
| ***F41A 9/64*** | (2006.01) |
| ***F41G 1/00*** | (2006.01) |

(Continued)

(52) U.S. Cl.

CPC ... *F41C 3/00* (2013.01); *F41A 3/00* (2013.01); *F41A 9/64* (2013.01); *F41A 17/00* (2013.01); *F41A 17/46* (2013.01); *F41A 19/11* (2013.01); *F41A 35/00* (2013.01); *F41C 23/10* (2013.01); *F41C 33/02* (2013.01); *F41C 33/0236* (2013.01); *F41G 1/00* (2013.01); *F41A 17/36* (2013.01); *F41A 35/06* (2013.01); *F41G 1/35* (2013.01)

(58) Field of Classification Search

CPC ..... F41C 23/00; F41C 23/10; F41C 9/00; F41C 9/02; F41C 33/048; F41C 33/08

See application file for complete search history.

(56) References Cited

U.S. PATENT DOCUMENTS

| | | | | |
|---|---|---|---|---|
| D7,933 | S | 12/1874 | Richards | |
| 297,412 | A * | 4/1884 | Kelton | 42/71.02 |

(Continued)

FOREIGN PATENT DOCUMENTS

| | | |
|---|---|---|
| EP | 0272819 | 6/1988 |
| EP | 1586846 | 10/2005 |
| WO | 00-65293 | 11/2000 |

*Primary Examiner* — Bret Hayes
*Assistant Examiner* — Derrick Morgan
(74) *Attorney, Agent, or Firm* — Robert Curcio; DeLio, Peterson & Curcio, LLC

(57) ABSTRACT

A handgun curved to correspond more closely with the contours of a person's body, achieving a comfortable fit when the handgun is worn for any appreciable amount of time on the person's body. The handgun housing is inclusive of a top portion, an intermediate portion, and a grip portion, which may be separately connected or integrally formed parts sharing a radius of curvature to form asymmetric left and right sides, particularly a concave side and a convex side. This asymmetry extends beyond the grip portion and includes at least a portion of the trigger guard and a portion of the magazine securing clip.

29 Claims, 28 Drawing Sheets

(51) Int. Cl.

| | |
|---|---|
| ***F41A 35/00*** | (2006.01) |
| ***F41C 33/02*** | (2006.01) |
| ***F41A 3/00*** | (2006.01) |
| ***F41A 17/00*** | (2006.01) |
| ***F41A 17/46*** | (2006.01) |
| ***F41A 19/11*** | (2006.01) |
| *F41A 17/36* | (2006.01) |
| *F41A 35/06* | (2006.01) |
| *F41G 1/35* | (2006.01) |

(56) References Cited

U.S. PATENT DOCUMENTS

| | | | | | |
|---|---|---|---|---|---|
| 566,367 | A | | 8/1896 | Wright | |
| 1,042,837 | A | | 10/1912 | Tatarek | |
| 1,898,368 | A | * | 2/1933 | Hess et al. | 42/71.02 |
| 1,962,775 | A | | 6/1934 | Jones | |
| 3,128,571 | A | | 4/1964 | Herrett | |
| 3,276,323 | A | | 10/1966 | Dieckmann | |
| RE26,872 | E | | 4/1970 | Dieckmann | |
| D219,020 | S | * | 10/1970 | LaViolette | D22/104 |
| 3,672,084 | A | * | 6/1972 | Pachmayr | 42/71.02 |
| D225,847 | S | | 1/1973 | Lichtman | |
| D230,974 | S | | 3/1974 | Howlett | |
| 3,857,322 | A | | 12/1974 | Lichtman | |
| 4,058,921 | A | * | 11/1977 | Mason | 42/1.08 |
| D247,855 | S | * | 5/1978 | Schiermeier | D22/104 |
| D257,166 | S | | 9/1980 | Hogue | |
| D263,413 | S | | 3/1982 | Hillberg | |
| 4,332,097 | A | | 6/1982 | Taylor, Jr. | |
| D277,126 | S | | 1/1985 | Numbers | |
| 4,660,311 | A | * | 4/1987 | Breitfeld et al. | 42/72 |
| 4,862,618 | A | | 9/1989 | Szabo | |
| 4,878,304 | A | * | 11/1989 | Cupp | 42/71.02 |
| 5,406,731 | A | * | 4/1995 | Stevens | 42/71.02 |
| 5,425,299 | A | * | 6/1995 | Teetzel | 89/14.4 |
| D377,513 | S | * | 1/1997 | Lenkarski et al. | D22/104 |
| D387,842 | S | * | 12/1997 | Kaminski et al. | D22/104 |
| 5,956,878 | A | | 9/1999 | Yang | |
| 6,256,915 | B1 | * | 7/2001 | da Silveira | 42/1.05 |
| 6,655,065 | B1 | | 12/2003 | Chapman | |
| 6,804,907 | B1 | * | 10/2004 | Slobodkin | 42/71.02 |
| 7,786,397 | B2 | * | 8/2010 | Dick | 200/332.2 |
| D630,290 | S | | 1/2011 | Velasquez et al. | |
| 7,937,875 | B1 | * | 5/2011 | Berg | 42/72 |
| 8,006,423 | B1 | | 8/2011 | Alzamora et al. | |
| D650,880 | S | * | 12/2011 | McGarry | D22/104 |
| 8,151,504 | B1 | * | 4/2012 | Aiston | 42/71.02 |
| 8,186,086 | B2 | | 5/2012 | Gur-Ari et al. | |
| D664,609 | S | | 7/2012 | Johnson | |
| 8,601,734 | B1 | * | 12/2013 | Hopkins et al. | 42/73 |
| 8,720,094 | B2 | * | 5/2014 | McPherson | 42/6 |
| 2004/0107621 | A1 | * | 6/2004 | Segalle | 42/71.02 |
| 2005/0188587 | A1 | * | 9/2005 | Danas | 42/72 |
| 2008/0005951 | A1 | * | 1/2008 | Gorzen | 42/14 |
| 2009/0193702 | A1 | * | 8/2009 | Lin | 42/72 |
| 2011/0072704 | A1 | | 3/2011 | Teach et al. | |
| 2011/0167698 | A1 | * | 7/2011 | Hoguc | 42/71.02 |
| 2012/0124885 | A1 | * | 5/2012 | Caulk et al. | 42/146 |
| 2012/0222342 | A1 | * | 9/2012 | Chvala | 42/74 |
| 2013/0312304 | A1 | * | 11/2013 | McPherson | 42/6 |
| 2014/0250754 | A1 | * | 9/2014 | Soults | 42/71.02 |

* cited by examiner

BODY CONTOURED HANDGUN

BACKGROUND OF THE INVENTION

1. Field of the Invention

The present invention relates to handguns, and specifically to pistols and revolvers. More particularly, the present invention relates to handguns having a curvature contoured to a person's body that enables the holder of the handgun to secure comfortably the handgun on his or her person for extended periods of time. The present invention further relates to contoured handguns having laser and light capabilities incorporated directly within the handgun casing, and handguns having a bore-axis sighting component.

2. Description of Related Art

Generally, when a person of ordinary skill in the art considers a "curved" firearm, reference is made to those firearms with the ability for utilizing a barrel placed at an angle from the original line-of-sight to facilitate the firing of the weapon in a direction different from the line-of-sight, such as around a corner. There have been many attempts in the past to modify rifles and handguns in order to have these firearms shoot at an angle from the line-of-sight.

For example, the German Sturmgewehr (StG.44), like its earlier versions MP.43 and MP.44m, is a gas operated, selective firearm. The StG.44 also could be fitted with a special curved barrel attachment ("Krummlauf"), which allowed the gun to be fired "around the corner" or inside a tank, without exposing the shooter to the enemy fire. Several types of these attachments were developed, but only one type, the 30-degree "KrummlaufVorsatz J", was apparently manufactured in any significant numbers. This device had a special mirror sighting adapter and reduced the bullet velocity down to mere 300 meters per second due to the high friction in the curved barrel extension.

Reference to curved barrel firearms, such as the aforementioned, does not include or consider curving the firearm body for a form-fit placement against the user's body when held in a holster. As a practical matter, well over 99% of the time a concealable firearm is with a person, it is holstered against the person's body, and current holstering arrangements require an ergonomic consideration regarding the body—handgun interface to be borne by the holster alone.

The unresolved issue is that a person's body is curved or contoured a certain way, and firearms are not correspondingly curved or contoured for a comfortable fit. The more pronounced a person's curves are, the more uncomfortable it becomes to holster a gun against the person's body. Most likely, both ends of a straight piece of metal held securely against a curved waist will be driven into a person's body and be uncomfortably worn. Approaches in the prior art to solving this problem have focused solely on the holster and especially the holster placement. Holster placement has been divided into two broad categories: those which move the gun away from the waist, and those which move it away from the hip. A high-ride design raises a holstered gun so that more of the gun rides above the belt, and thus avoids pulling the gun into the waist curve. It is comfortable, stable, and easy to conceal, but with so much of the gun above the waist, drawing can be very difficult for "short-waist" persons or those with shoulder flexibility issues. Lowering the holster also gets the bulk of the gun off the waist. Comfortable when worn, a dropped holster design makes the gun very easy to draw. But the lower the gun rides, the more difficult it becomes to find a cover garment long enough to conceal the muzzle end.

Holster placement has long been a solution to concealment and comfort. Outside the waistband (OWB) or belt holsters, are most commonly used by police and military, and by citizens who choose to open carry. Belt holsters can be worn high and close to the body, slightly behind the hip bone, and can be concealed under a long, untucked shirt or jacket.

Inside the waistband (IWB) holsters, which clip or mount to a belt, allow one to securely holster the weapon inside the pants.

Shoulder holsters consist of two straps connected in a manner similar to a backpack, with the actual holster mounted to a strap on the right or the left side. Shoulder holsters are designed to position the handgun either in a vertical position with the barrel pointed generally toward the ground, in a vertical position with the barrel pointed generally upward, or in a horizontal position with the barrel pointed generally behind the wearer.

Sling holsters are similar to shoulder holsters, but instead consist of a band worn over one shoulder and another around the chest.

The "belly band" holster is a wide elastic belt with a built-in holster, usually worn under an untucked shirt to facilitate access. There are various types, worn at the belt line or higher, with the gun placement anywhere from in front to under the armpit. In order to remain in place, a belly band must be extremely tight, which is generally uncomfortable.

Pocket holsters are used for very small weapons, such as a back-up gun. In some designs, the end of the holster takes on shape of the bottom end of a garment pocket.

Small of back holsters place the weapon directly over the center of the back, allowing for even large handguns to be carried with little printing. While both comfortable and stylish, should the wearer fall onto the weapon (such as in a close quarters fight) serious spinal injury may occur.

Groin holsters place the handgun mostly below the waistline around the 12:00 position.

Thigh holsters are a popular military and police item that holds the sidearm on the right leg where the hand naturally hangs, making for a fast draw. Early U.S. cavalry units used these in the early 1900s with a leather thong strapping it to the leg. Modern ones often use a drop leg PALS (Pouch Attachment Ladder System) grid with a modular holster attached, often with buckles for quick release. Police and military personnel wear these when a bulky vest makes belt carry impractical.

Ankle holsters offer excellent concealment and are used by law enforcement officials who wish to carry a secondary weapon to back up their primary firearm.

Chest holsters can be attached to compatible vests and chest carriers. Like shoulder holsters, chest holsters are often easier to draw from than belt holsters when the operator is seated inside a vehicle.

Strut holsters are used exclusively for concealed carry. They are worn above the trouser belt line as a cross draw holster located directly under one's arm (9 o'clock position) or toward the front of the body (10 to 11 o'clock position). The design contains a strut which is shaped to nest behind one's trouser belt and attach to the holster at the other end. The strut transfers the weight of the firearm to the belt and retains the weapon in place for secure removal.

In all instances, it is the holster placement and/or shape that aids in concealment and, most importantly, comfort for long-time wearing of a firearm. The firearm itself remains unchanged in design and contour.

Other ergonomic designs include reforming the pistol grip to allow the user better gripping and handling. Typically, this involves contouring the pistol grip for the shape of the hand such as disclosed in EP 0272819 issued to William Batterman Ruger on Aug. 4, 1993, titled "Grips For Handgun." Additionally, the pistol grip may be formed with indentations for receiving the trigger hand fingers, such as disclosed in U.S. Pat. No. D527,166 issued to Hogue on Sep. 30, 1980 titled "One Piece Pistol Grip." Pistol grips in the prior art are substantially symmetric in design, such as disclosed in U.S. Pat. No. 5,406,731 issued to Stevens on Apr. 18, 1995 titled "Handgun of Improved Ergonomic Construction."

SUMMARY OF THE INVENTION

Bearing in mind the problems and deficiencies of the prior art, it is therefore an object of the present invention to provide a firearm having a housing contoured for the shape of a person's body for extended comfortable wear and concealment.

It is another object of the present invention to provide a body contoured pistol or revolver housing contoured for placement within a corresponding holster for extended wear on a person's body.

It is a further object of the present invention to provide holsters for holding a body contoured firearm, where the holsters do not detract from the form fit design of the contoured firearms.

It is another object of the present invention to provide a firearm having a contoured housing that incorporates a light or laser module.

It is yet another object of the present invention to provide a bore-axis sight for a contoured handgun that also serves as an indicator for when a cartridge is loaded in the barrel.

Still other objects and advantages of the invention will in part be obvious and will in part be apparent from the specification.

DETAILED DESCRIPTION OF THE INVENTION

The housing of a handgun is purposely curved to correspond more closely with the contours of a person's body so that the handgun achieves a comfortable fit when it is worn for any appreciable amount of time on the person's body.

Although the present invention implements this body contoured feature for pistols and revolvers, it is not limited to only these types of handguns, and other firearms may be so designed to provide a more comfortable wear against a person's body.

The curved design is performed on housing parts of a handgun that are normally in contact with the user's body, while maintaining straight or linear translation of the firing components. Consequently, the barrel remains true to the target line-of-sight. The grasping portion of the housing is curved either right or left depending upon the user's preference to facilitate a right-handed or left-handed shooter. The right or left housing curvature will dictate on which side of the body the handgun will be holstered, since the curvature is specifically designed to be body contoured. Similarly, a right or left curved holster is introduced to accommodate the curvature of a particular handgun.

Figure 1:
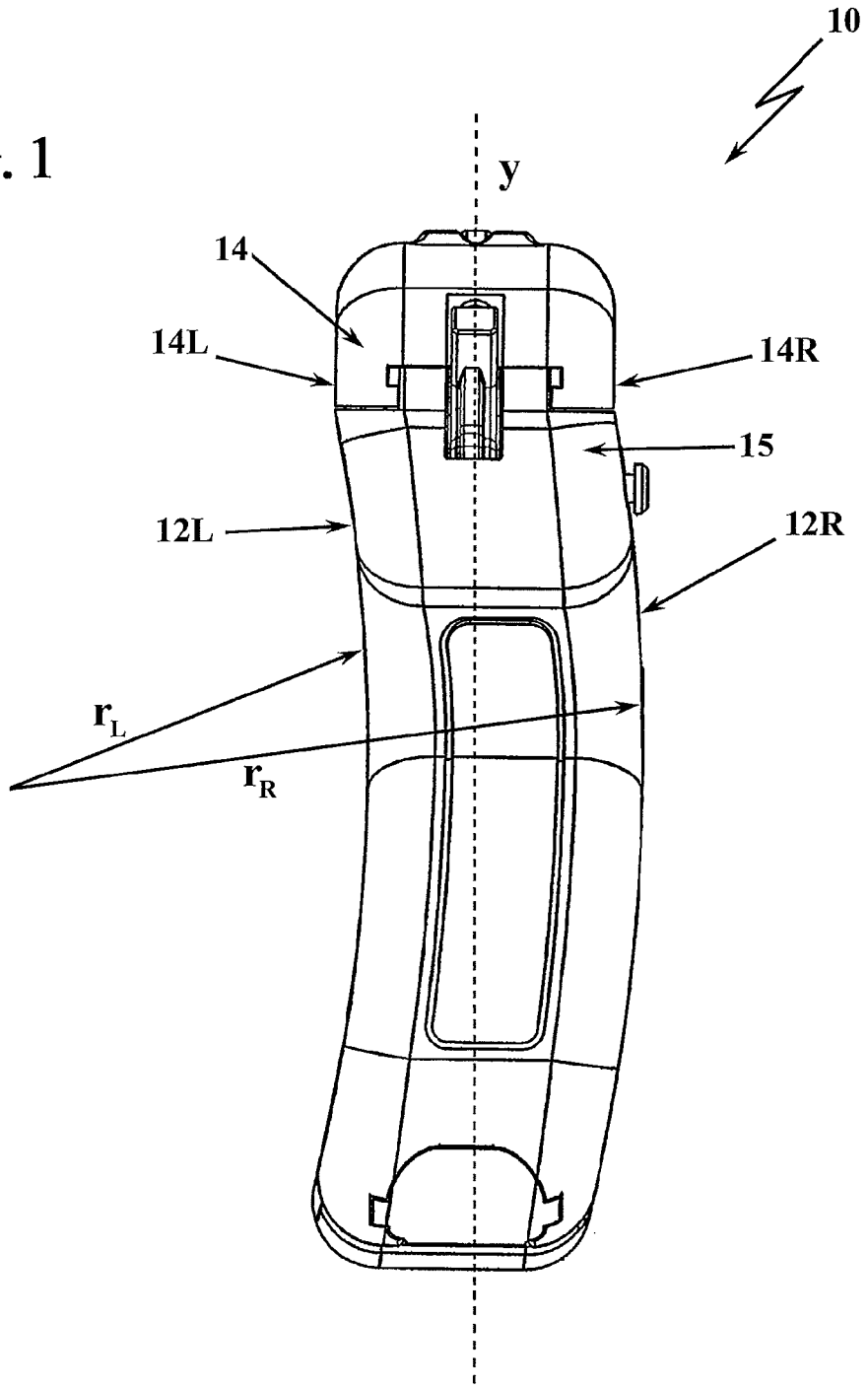
FIG. 1 is a rear view of a curved pistol of the present invention.

FIGS. 1-6 depict different views of a handgun 10 of the present invention. In this embodiment, handgun 10 is depicted as a pistol; however, the present invention is not so limited, and the handgun may be a revolver. FIG. 1 is a rear view of curved pistol 10 with pistol housing 12 having a left side 12L and a right side 12R. Left side 12L is concave inwards, and right side 12R is convex outwards from the pistol normal axis or vertical plane "y". Housing 12 is shown curved with approximate radii of curvature rL and rR, representing the curvature of left side 12L, and the curvature of the right side 12R of housing 12, respectively. Curvature of radius rL is an approximate measure of the concave nature of left side 12L of housing 12, while curvature of radius rR is an approximate measure of the convex nature of the right side 12R of housing 12. The approximate radii of curvature of housing 12 need not be equivalent, and may be varied depending upon the desired degree of curvature of the concave or convex portions of housing 12. In at least one embodiment, slide 14 of pistol 10 has left and right sides 14L, 14R approximately parallel to vertical plane "y", and a top portion perpendicular to vertical plane "y". Thus, in this embodiment, the curvature of housing 12 stops at slide 10. In an alternate design, either or both sides 14L and 14R of slide 14 may extend the approximate curvature of housing 12. Preferably, sides 14L, 14R are parallel with vertical plane "y" to facilitate gripping and translation of slide 14 in a direction along to vertical plane "y" (in a direction towards or away from the muzzle end of the pistol).

The handgun of the present invention includes a housing having asymmetric sides, particularly a concave side and a convex side. In one embodiment, this asymmetry extends beyond the grip portion and includes at least a portion of the frame or chassis.

Figure 2:
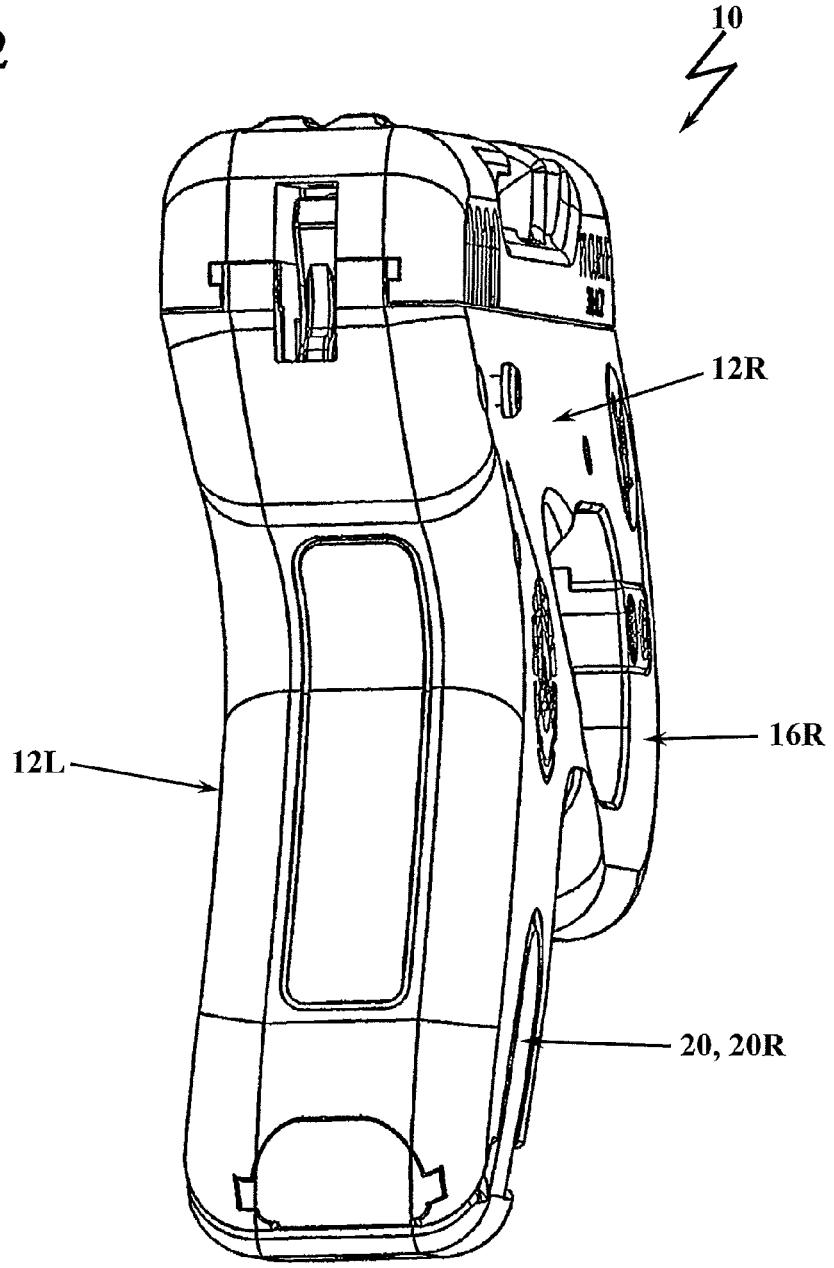
FIG. 2 is a rear perspective, right side view of the curved pistol of the present invention.

FIG. 2 is a rear perspective, right side view of curved pistol 10. From this angle, the convex curvature of right side 12R of housing 12 is depicted along with an edge of left side 12L shown in concave fashion. The housing portion 16R that forms the right side of a trigger guard is shown curved along with the convex curvature of right side 12R. From the perspective of FIG. 2, in this embodiment, the right side 20R of clip portion 20 of the magazine is curved accordingly to extend the convex curvature of right side 12R of housing 12.

Figure 3:
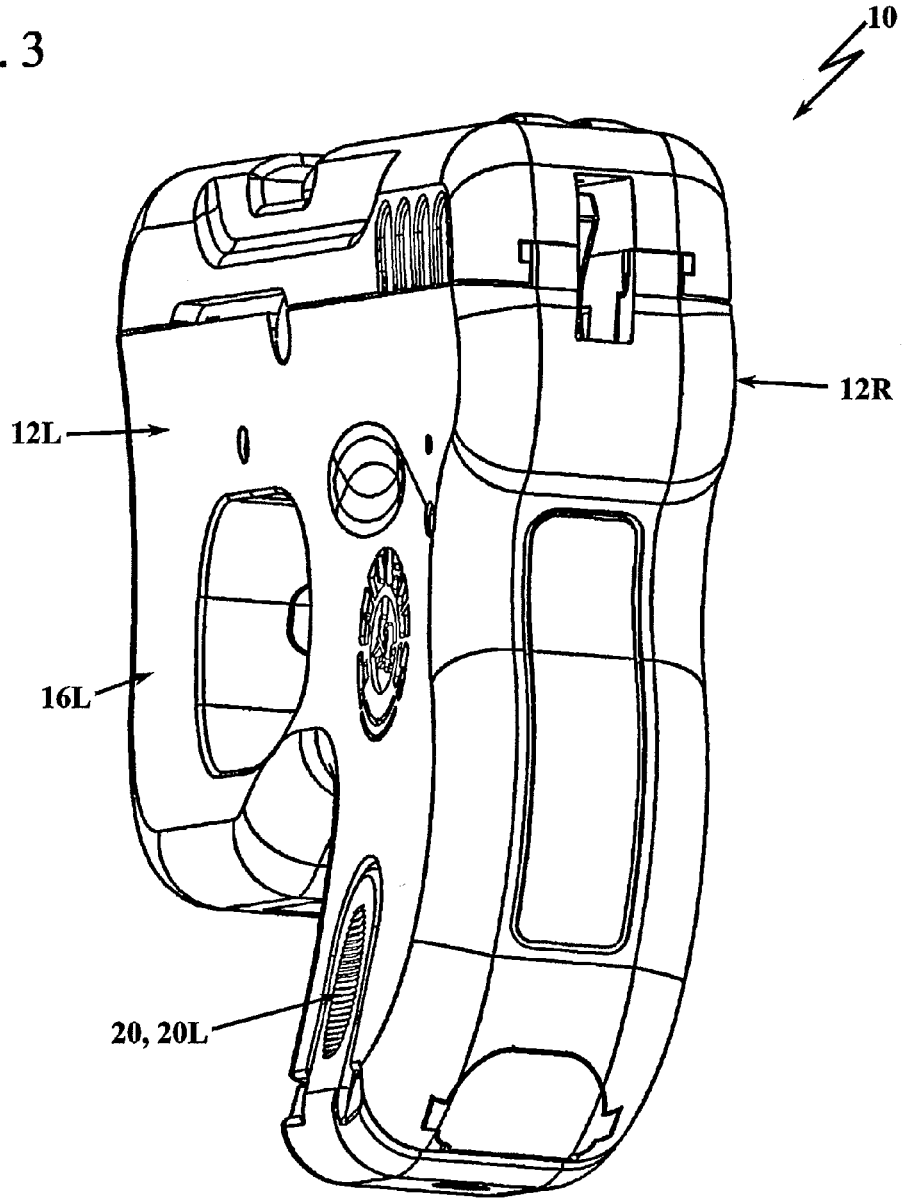
FIG. 3 is a rear perspective, left side view of the curved pistol of the present invention.

FIG. 3 is a rear perspective, left side view of curved pistol 10. From this angle, the concave curvature of left side 12L of housing 12 is depicted along with an edge of right side 12R shown in convex fashion. The housing portion 16L that forms the left side of the trigger guard is shown curved along with the concave curvature of left side 12L. From the perspective of FIG. 3, in this embodiment, the left side 20L of clip portion 20 of the magazine is curved accordingly to extend the concave curvature of left side 12L of housing 12.

Figure 4:
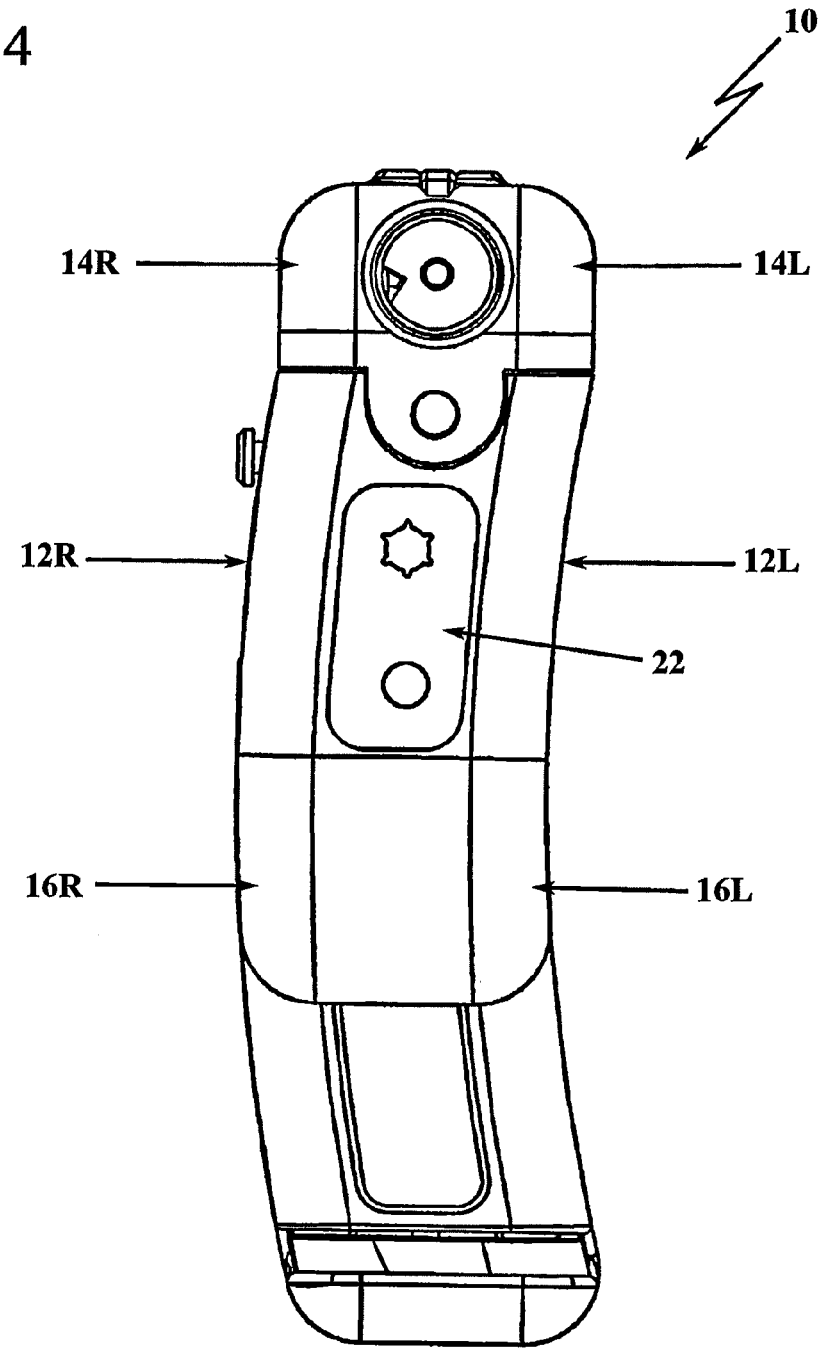
FIG. 4 is a front view of a curved pistol of the present invention.

FIG. 4 is a front view of curved pistol 10. The desired curvature is distinctly shown in this view of the handgun. Specifically, the convex and concave nature of housing 12 is clearly evident. In this embodiment, slide 14 does not share the same asymmetry in curvature as housing 12. However, the present invention is not so limited, and in other embodiments slide 14 may extend the curvature of housing 12, provided the translational motion of slide 14 is preserved. Also depicted in FIG. 4 is a laser/light module 22, that is encased in or integral with housing 12. Prior art laser sighting and light modules are components that are attached to the handgun housing. In a preferred embodiment, housing 12 is formed to encase laser/light module 22. In this manner, handgun housing 12 is also the curved housing for supporting a laser/light module. The housing curvature is not interrupted by the addition of laser/light module 22.

Figure 5:
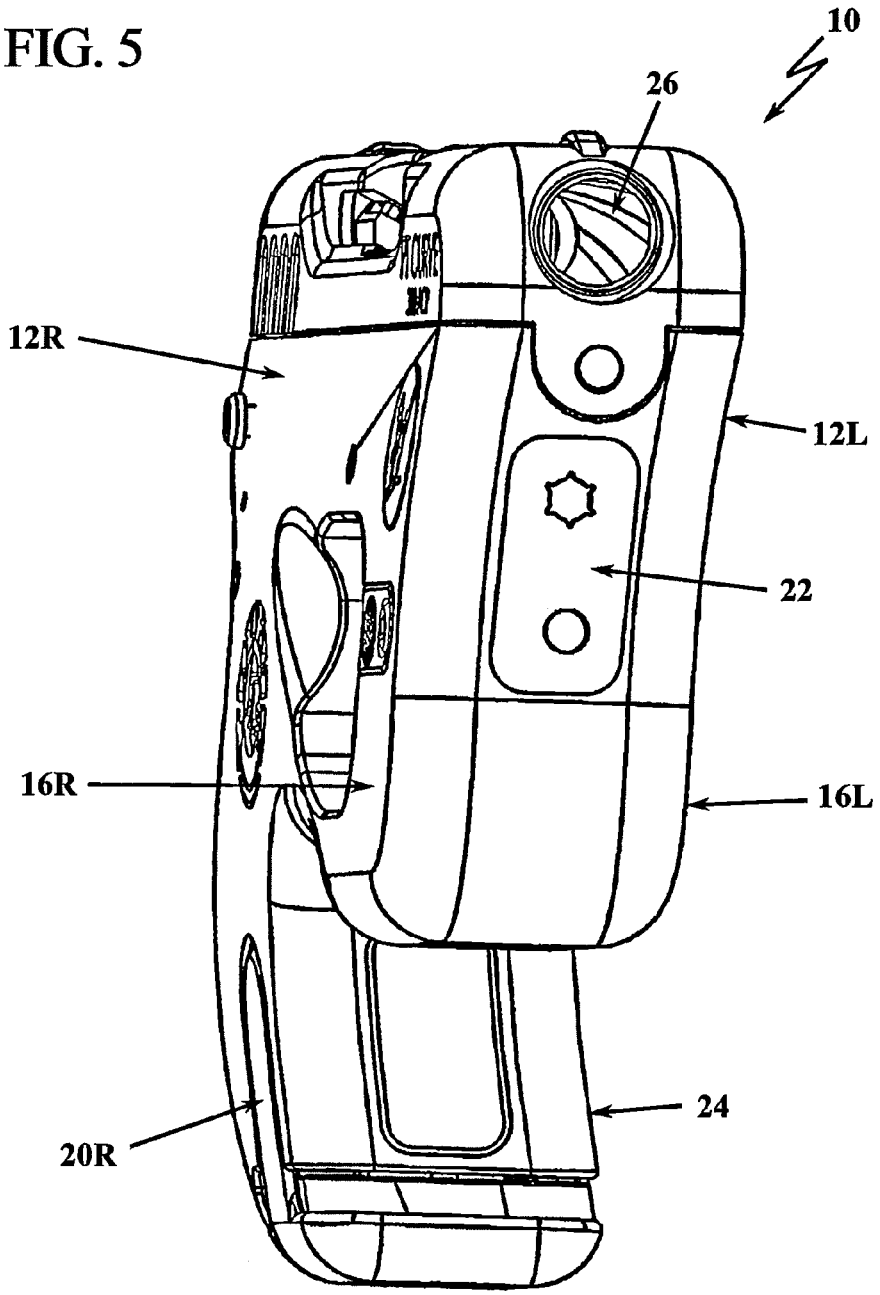
FIG. 5 is a front perspective, right side view of the curved pistol of the present invention.

FIG. 5 depicts a front perspective view of pistol 10. The lower portion of pistol 10 that includes the pistol grip 24 is shown curved away from the vertical plane that dissects the barrel 26 center point. As shown, barrel 26 remains true to the line-of-sight, and is in line with the vertical plane of the pistol, but housing 12 deviates from this vertical plane in convex and concave fashion.

Figure 6:
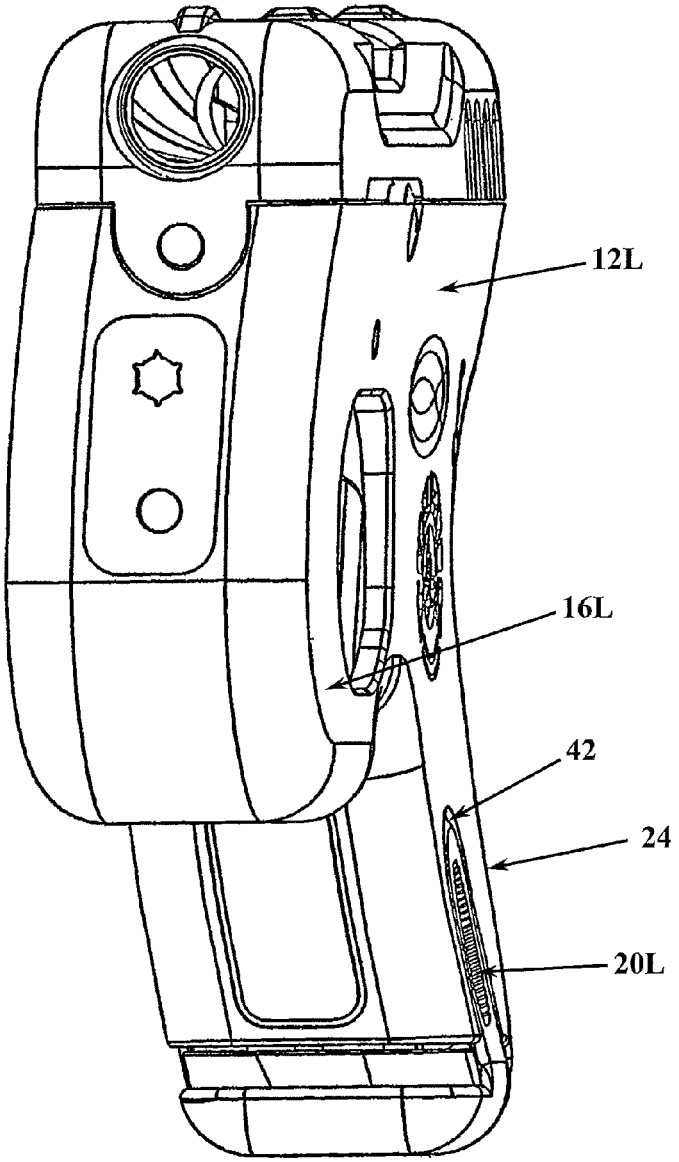
FIG. 6 is a front perspective, left side view of the curved pistol of the present invention.

FIG. 6 is a front perspective, left side view of curved pistol 10. The curved nature of magazine clip 20L is depicted at the base of grip 24. Clip 20 is angled to match the curvature of each side of pistol housing 12. The left side 20L of clip 20 is angled in a concave manner, while the right side 20R of clip 20 follows the convex curvature of housing 12R. Housing 12 is formed with curved indentations 42 on each side of grip 24 for receiving the clip portions 20R, 20L of clip 20.

In the preferred embodiments, it is not just the pistol or revolver hand grip that is curved from the vertical plane; a portion of the upper housing is body-contoured as well. Skewing of the housing from the vertical plane is achieved while the barrel remains straight in the uniquely curved housing.

Housing curvature is achieved by curving one side of the housing in a concave direction, and the opposite side of the housing in a convex direction. In a separate embodiment, only one side of the housing may be curved, preferably the side facing the user when the handgun is carried by the user. This allows the concave curved side of the housing facing the user to be contoured to the user's body, while the opposite side remains relatively straight and true to the vertical plane.

Figure 7:
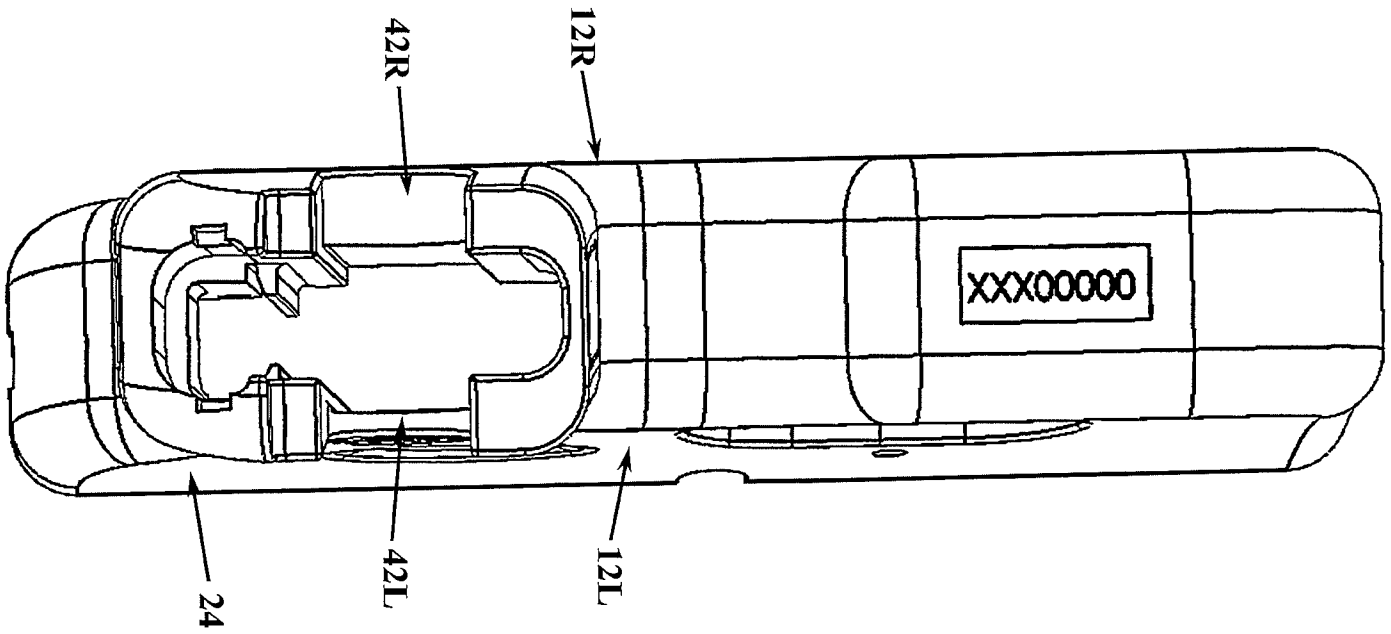
FIG. 7 depicts a bottom cross-sectional view of the pistol housing at the grip.

Each curved side of housing 12 may be of approximately the same thickness, or preferably, one side has a thickness that exceeds the opposite side. FIG. 7 depicts a bottom cross-sectional view of housing 12 at grip 24. This view exhibits the difference in thickness between right side housing 12R and left side housing 12L as measured at the bottom side of indentations 42 on the pistol right side, shown by indentation face 42R, and on the pistol left side, shown by indentation face 42L. Pistol housing right side 12R has a greater thickness than pistol housing left side 12L for the approximate extent of the curvature, where the pistol right side represents the convex curvature side of the handgun and the pistol left side represents the concave curvature side of the handgun. The difference in housing side thickness is further realized by magazine clip 20, where the left side 20L of clip 20 is smaller in width or thickness than the right side 20R of clip 20 to correspond with the left side 12L and right side 12R of housing 12.

For the curved pistol of the present invention, it is preferred for magazine 38 to enter the hand grip 24 approximately true to the vertical plane. Magazine clip 20 is curved or angled to extend and continue the housing curvature to the lower portion of grip 24. Alternatively, magazine 38 may enter the hand grip 24 at an angle to the vertical plane to accommodate the arch-shaped housing.

Figure 8:
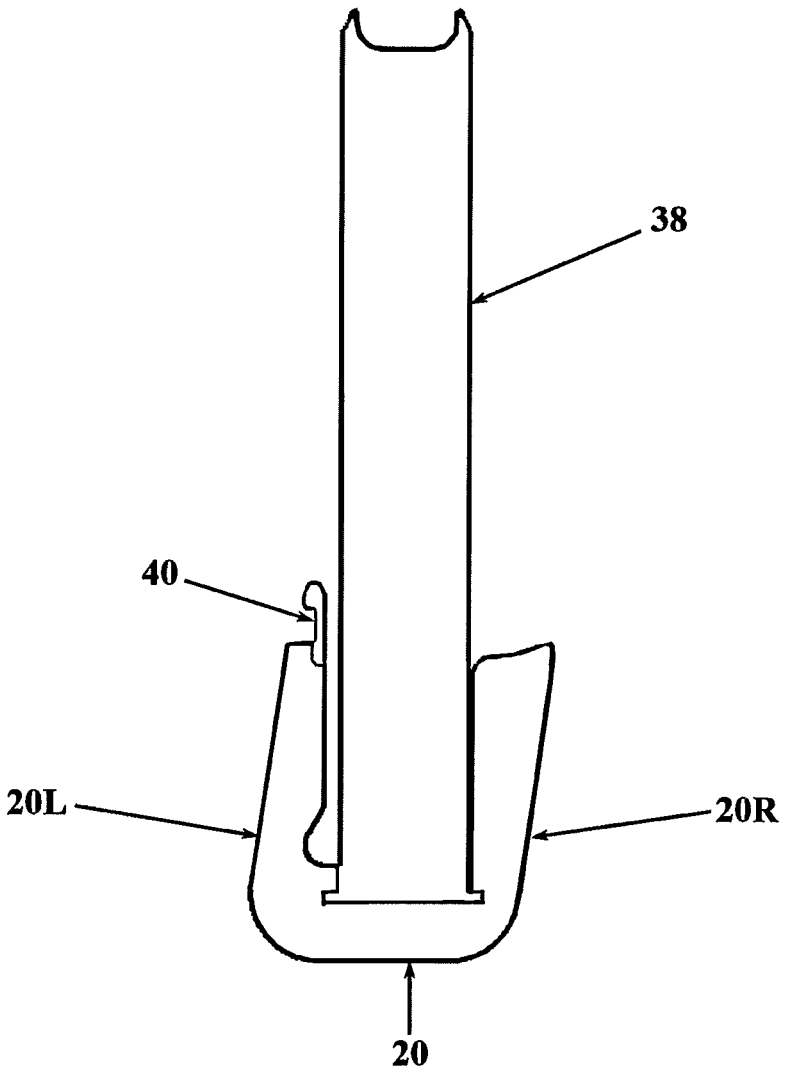
FIG. 8 depicts the magazine for the curved pistol of the present invention with attached magazine clip.

In a preferred embodiment, magazine clip 20 releasably secures magazine 38 within pistol grip 24. Thus, pistol housing 12 is free of any release button or lever to remove magazine 38. FIG. 8 depicts magazine 38 with magazine clip 20 attached. Magazine clip 20 is releasable secured to housing 12 by at least one resilient, compression activated locking/ release clip 40. In the embodiment depicted by FIG. 8, compression activated locking/release clip 40 is mounted to only one side of magazine clip 20, here shown as left side 20L, although either side, or both sides of clip 20 may have compression activated locking/release clips mounted thereon.

Figure 9:
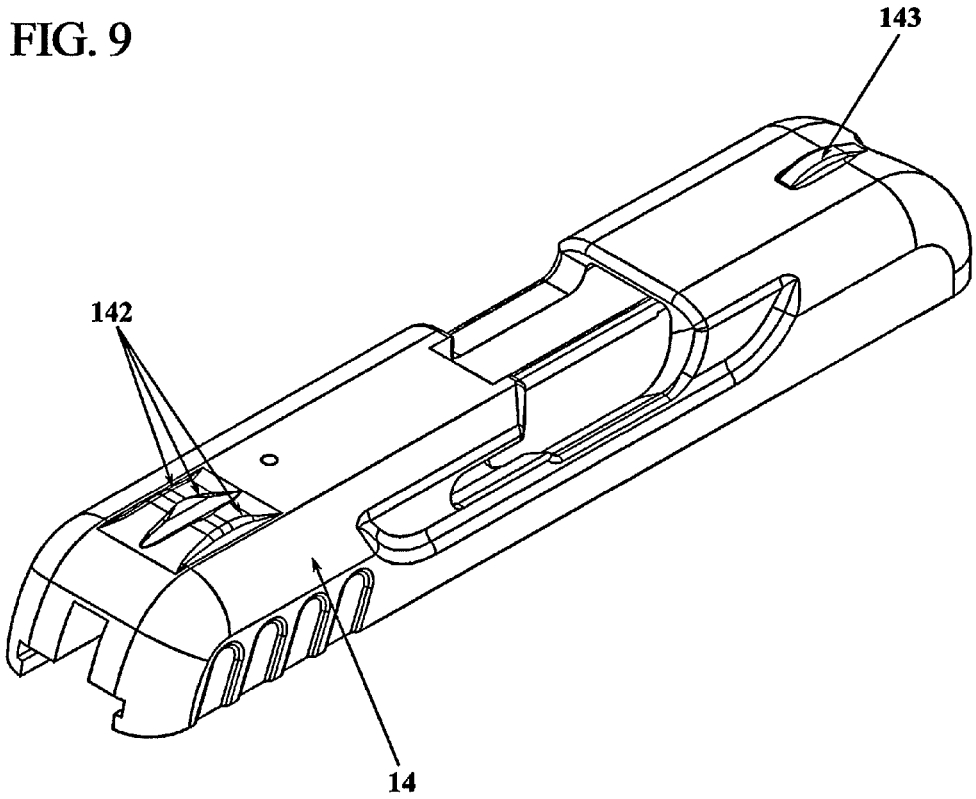
FIG. 9 depicts a perspective view of a first embodiment of the slide for the pistol of the present invention.

FIG. 9 depicts a perspective view of a first embodiment of slide 14 of pistol 10. In this embodiment, a sight system of shaped alignment markers 142, 143 (usually metal) is used as a sighting device to assist in the aiming of the pistol. These so-called iron sights are typically composed of two component sights, formed by metal blades: a rear sight configuration 142 mounted perpendicular to the line of sight and a front sight 143 that is a generally a post, bead, or ring.

Figure 10A:
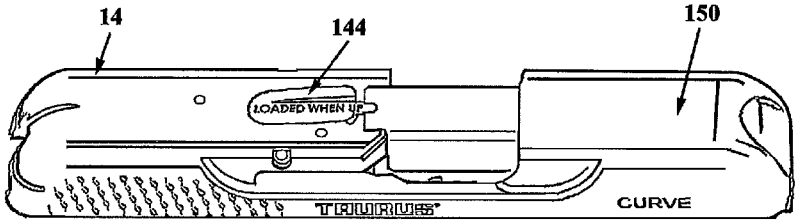
FIG. 10A depicts an alternative embodiment of the slide of the present invention in the absence of iron sights.

FIG. 10A depicts an alternative embodiment of slide 14 of the present invention in the absence of iron sights. In this alternative embodiment, a chamber load indicator 144 is presented, and may be formed to serve two purposes. First, chamber load indicator 144 is a pivotable, spring tensioned member that, when activated, raises above the plane of top surface 150 of slide 14 and indicates to the user that a bullet is in the chamber.

Figure 10B:
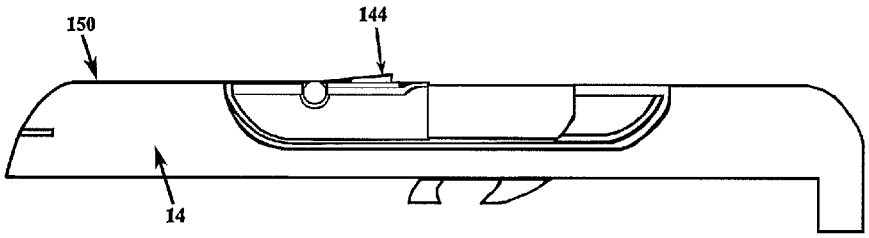
FIG. 10B depicts the position of the chamber load indicator of the slide of the present invention when a bullet is in the chamber.

FIG. 10B depicts the position of chamber load indicator 144 when activated, that is, when a bullet is in the chamber. Second, chamber load indicator 144 may be grooved or dovetailed to provide sighting capability as well as load indication.

Figure 11:
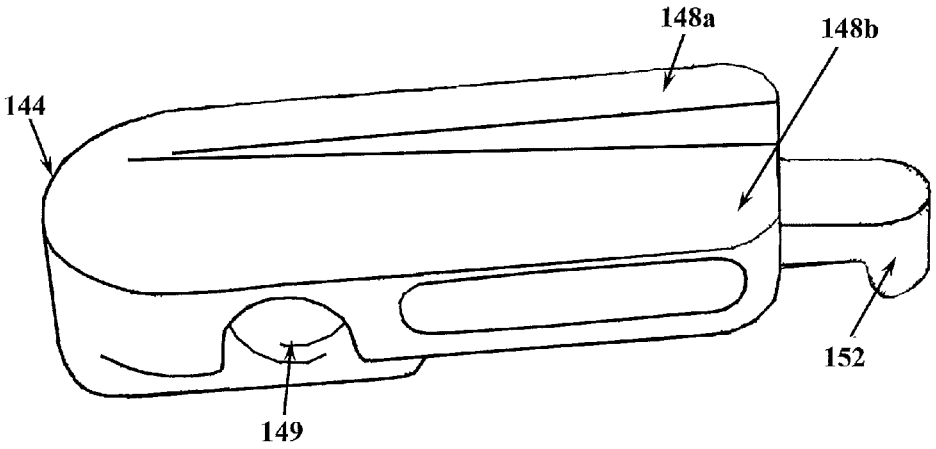
FIG. 11 depicts a chamber load indicator with sighting grooves at an end approximately opposite the pivoting point of the chamber load indicator.

FIG. 11 depicts chamber load indicator 144 with sighting grooves 148*a,b* at an end approximately opposite pivoting point 149 of chamber load indicator 144. Tab 152 provides a contact point for activation either by a bullet itself or by a component, such as a lever arm, that is in mechanical communication with either a chambered bullet or the pistol magazine.

Figure 12:
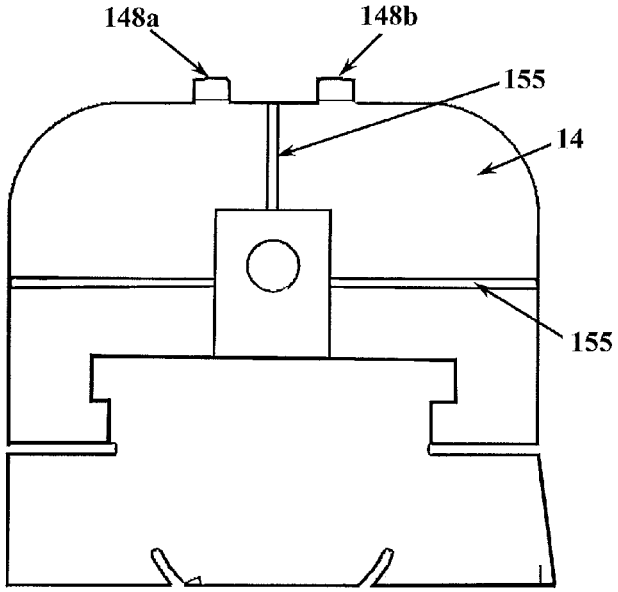
FIG. 12 depicts the back of the slide with a chamber load indicator raised in the activated position.

FIG. 12 depicts the back of slide 14 with chamber load indicator 144 raised in the activated position. In an alternative embodiment, crosshairs 155 are embedded within or inscribed upon on the back side of slide 14 to assist in sighting.

Figure 13:
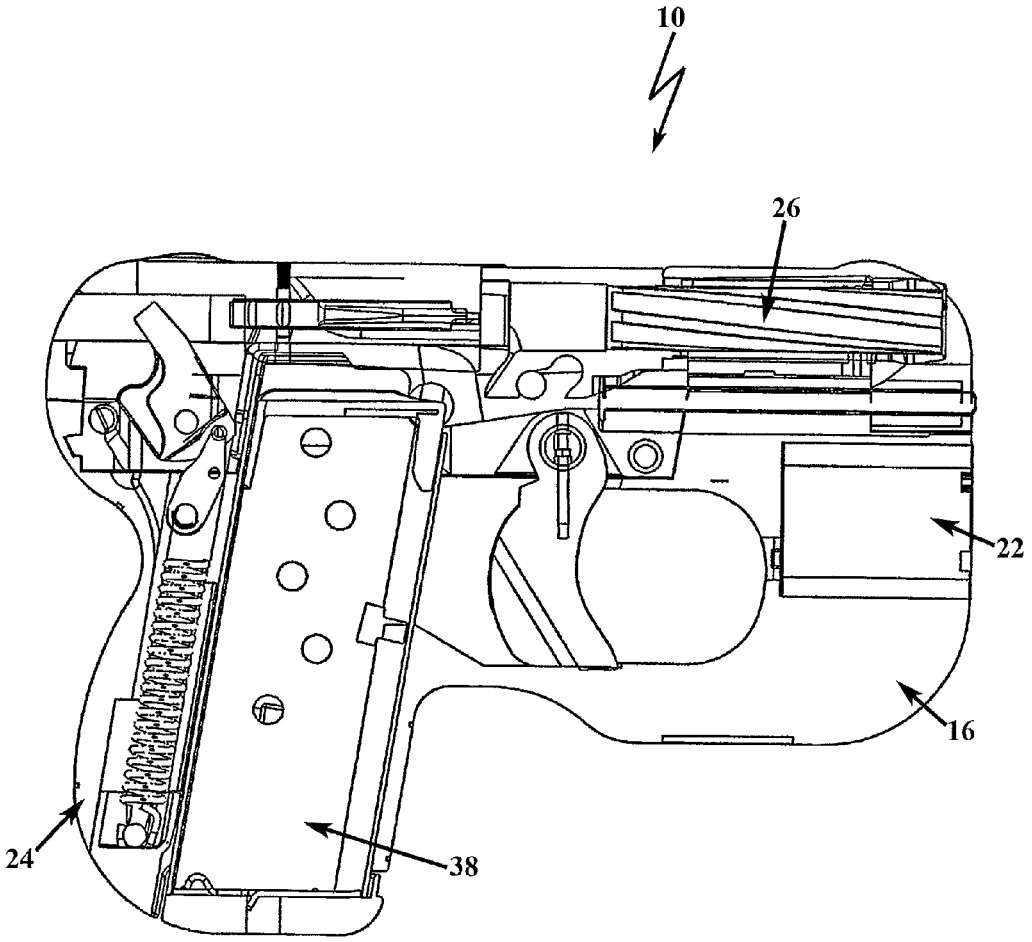
FIG. 13 is a cross-sectional view of one embodiment of the curved pistol of the present invention that depicts the approximate placement of the magazine in relation to and within the grip.

FIG. 13 is cross-sectional view of one embodiment of the curved pistol of the present invention that depicts the approximate placement of magazine 38 in relation to and within grip 24.

Figure 14:
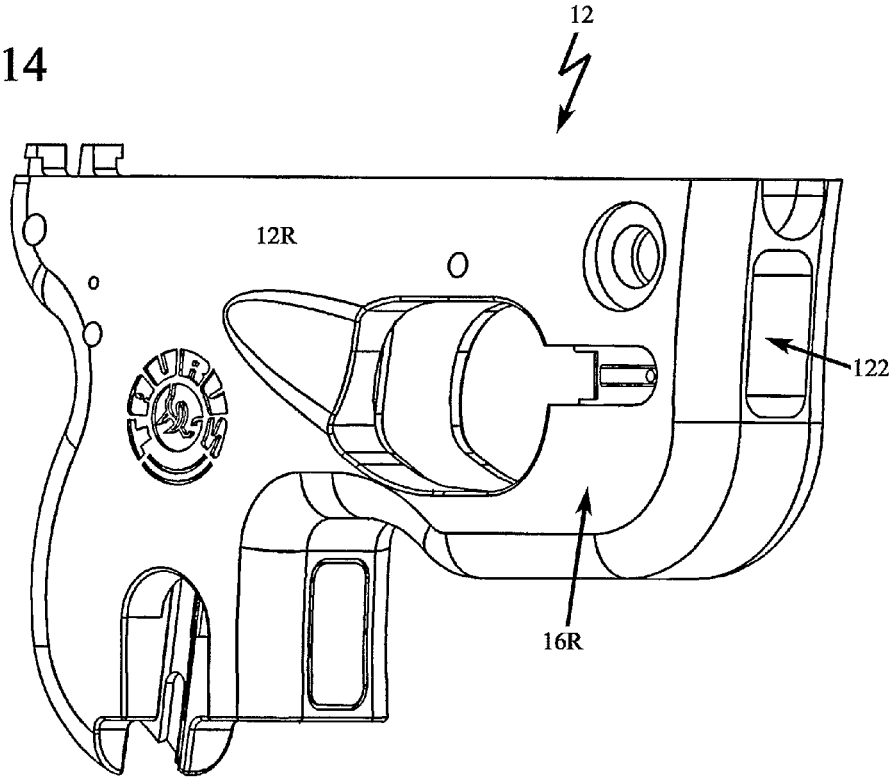
FIG. 14 depicts the housing of the curved pistol of the present invention showing a front end aperture for mounting a laser/light module.
Figure 15:
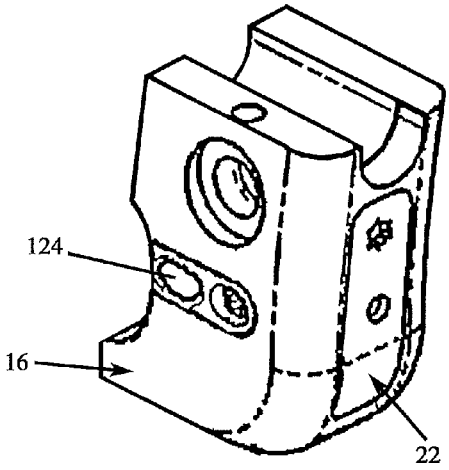
FIG. 15 identifies a laser/light sighting module inserted within a portion of the housing that forms part of trigger guard.

In one embodiment, the front end of curved pistol 10 includes laser/light module 22 for sighting. Housing 12 is formed with a cavity 122 open to the front end of pistol 10 for receiving and securing laser/light module 22. Laser/light module 22 is slidably insertable within cavity 122. The module is designed to be placed below the barrel, and in front of the trigger, and together with the housing, forms a portion of the trigger guard. FIG. 14 depicts housing 12 with cavity 122 having an open front-facing aperture for mounting laser/light module 22. A front view of module 22 mounted in a body contoured pistol 10 is shown in FIG. 5. Laser/light sighting module 22 is optional, and replaceable. FIG. 15 identifies laser/light sighting module 22 in a portion of housing 12 that forms part of trigger guard 16. A side on/off switch 124 is exposed for user activation with a single finger near the trigger. Switch 124 is preferably flush with the outside, exposed surface of housing 12 to promote a smooth casing exterior.

Laser sighting is preferably performed by a 5 mW Class Ma Red/Green laser at 630 nm to 670 nm wavelength, and light sighting is preferably performed by 3 LEDs at approximately 16 lumens, although other laser and light sources are feasible provided they are capable of slidably inserting within housing aperture 122.

Figure 16:
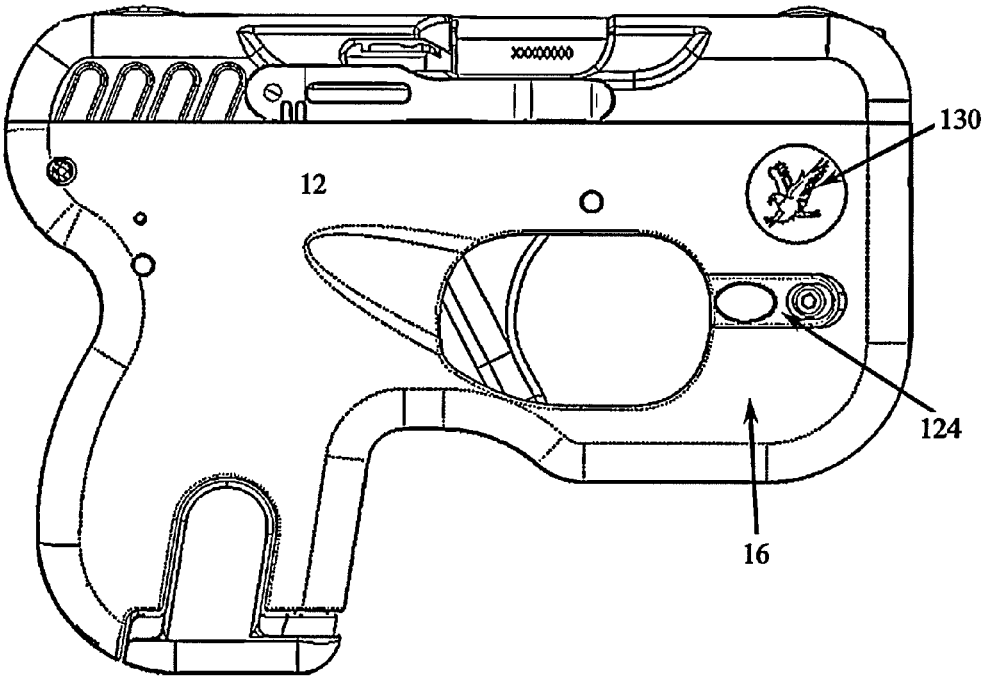
FIG. 16 depicts a customized button or other insignia incorporated on the curved pistol of the present invention.
Figure 17:
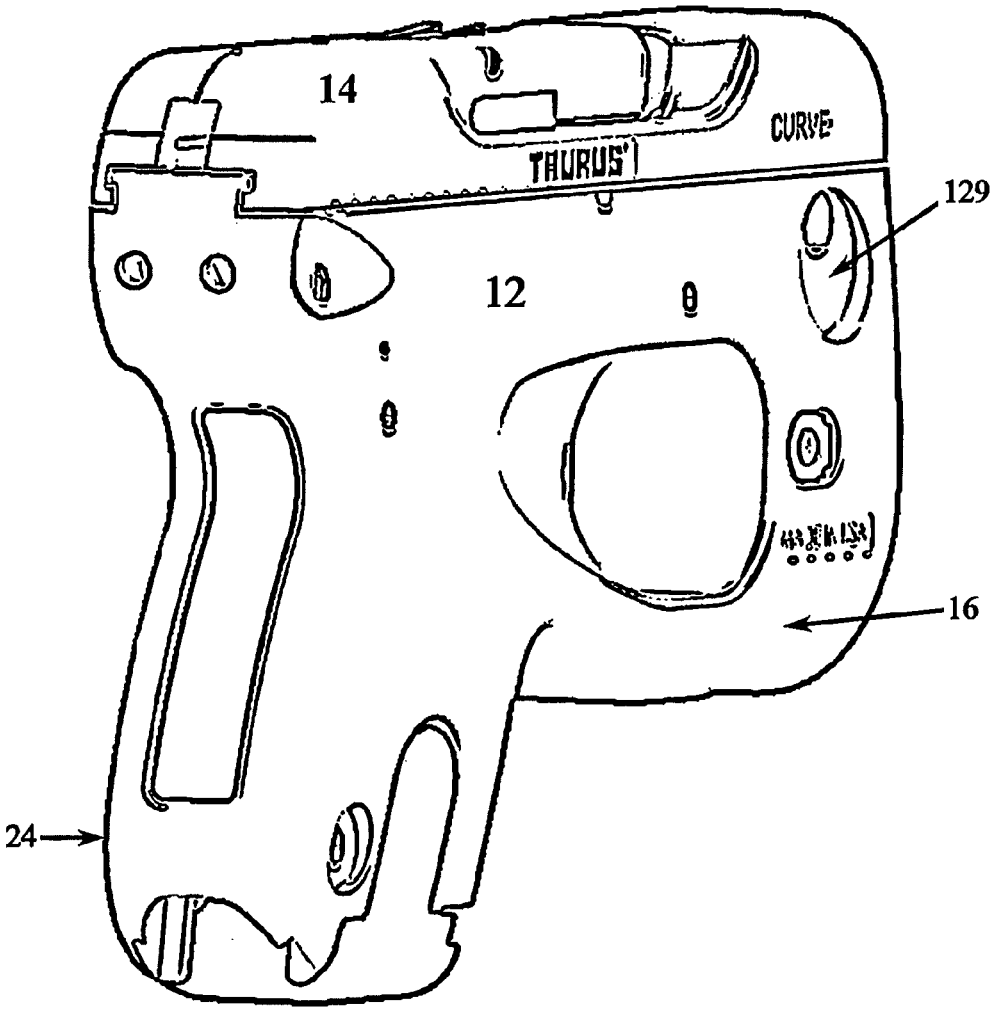
FIG. 17 depicts an indentation within the housing to receive the button of FIG. 16.

Alternatively, in another embodiment, an index finger hold is molded into the housing surface. A customized button 130 or other insignia may incorporated as depicted in FIG. 16. FIG. 17 depicts an indentation 129 within housing 12 to receive button 130. The exposed surface of button 130 is preferably of a reverse curvature from the curvature of the housing side upon which it is placed. In this manner, button 130 is itself indented respective to the housing curvature and forms an index finger hold for the user.

Figure 18:
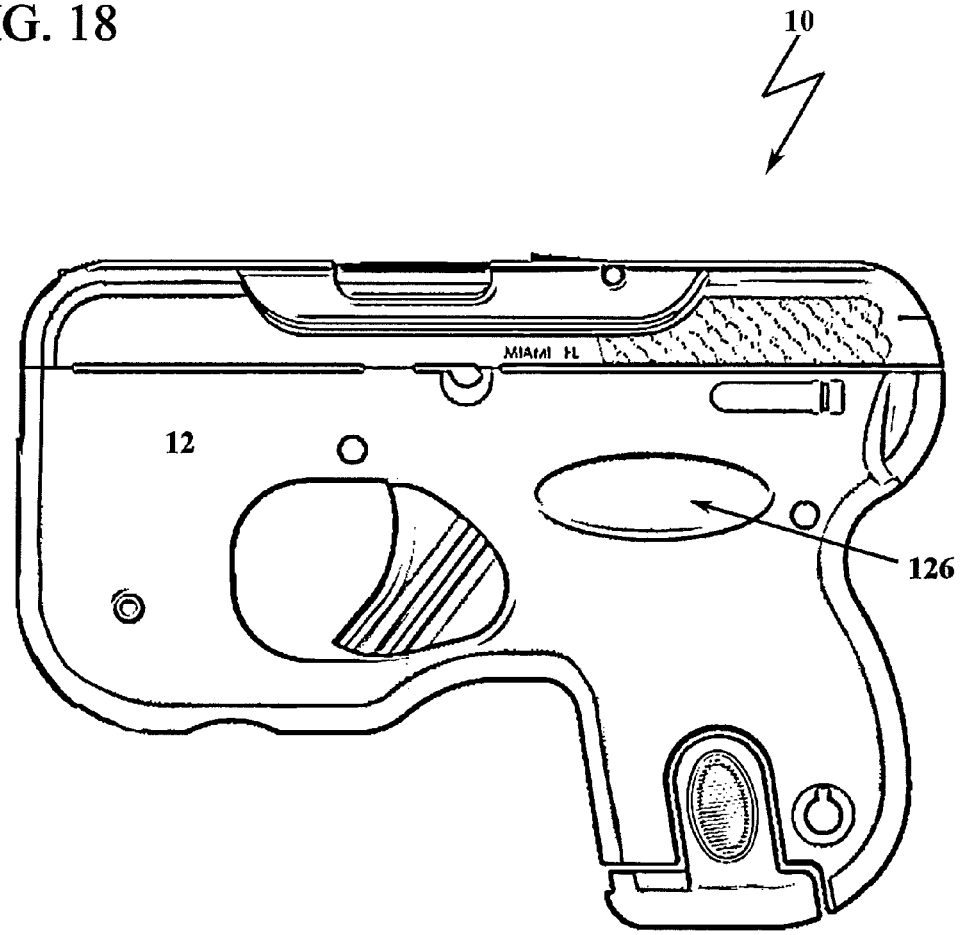
FIG. 18 depicts an indentation on the outside surface of the pistol housing for use as a thumb hold.

On the opposite side from button 130, an elongated indentation 126 in housing 12 is provided on at least one embodiment for a thumb hold. Indentation 126 is preferably molded within and integral with housing 12. FIG. 18 depicts indentation 126 on the outside surface of housing 12 for use as a thumb hold.

Figure 19:
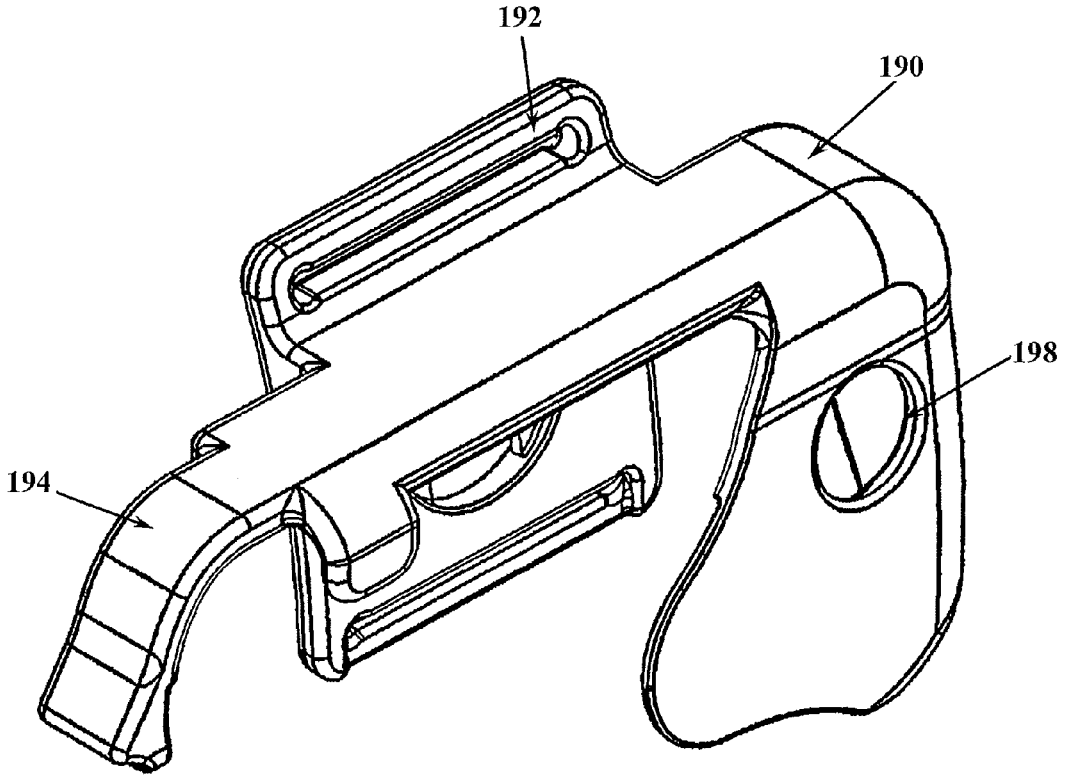
FIG. 19 is a perspective view of a holster for a body contoured handgun.
Figure 20:
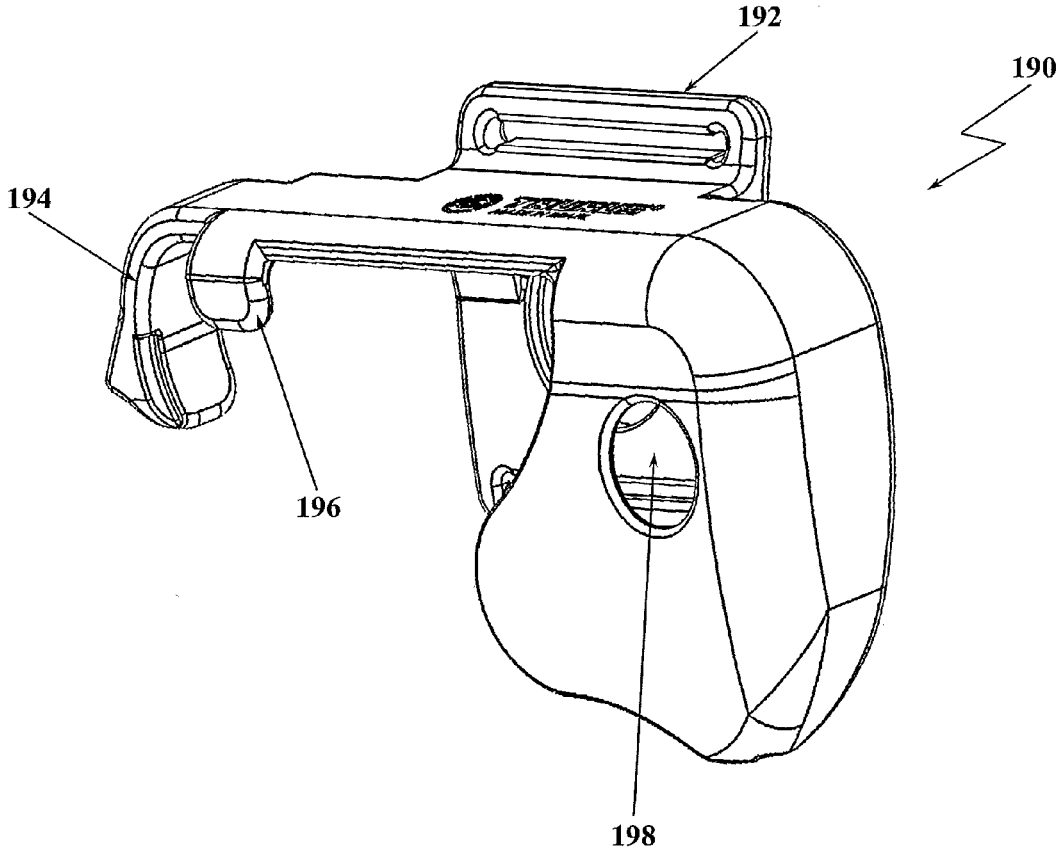
FIG. 20 depicts the front portion of the holster of FIG. 19 having a front portion enclosed to protect the laser/light module and barrel from contact and debris.

A unique holster design has been developed to accommodate the arch-shaped housing of a curved pistol or revolver. FIG. 19 is a perspective view of a holster 190 for a body contoured handgun. The predominantly open portion of the holster design allows for the curvature of the handgun's housing to be placed directly against a person's body. In this manner, the benefits of the handgun's curvature can be realized over long-time wear on a person's body, without the bulkiness of an interfering holster. An attachment clip 192 secures holster 190 to a belt or other strap on the person. Holster 190 is formed having a narrow, curved back portion 194 to releasably secure the back portion of housing 12 that abuts slide 14. A slide clip 196 may also be employed to secure pistol 10 to holster 190. FIG. 20 depicts the front portion of holster 190, which is enclosed to protect the laser/light module and barrel from contact and debris. The holster may include an aperture 198 for viewing customized button 130 while the handgun is holstered.

Figure 21:
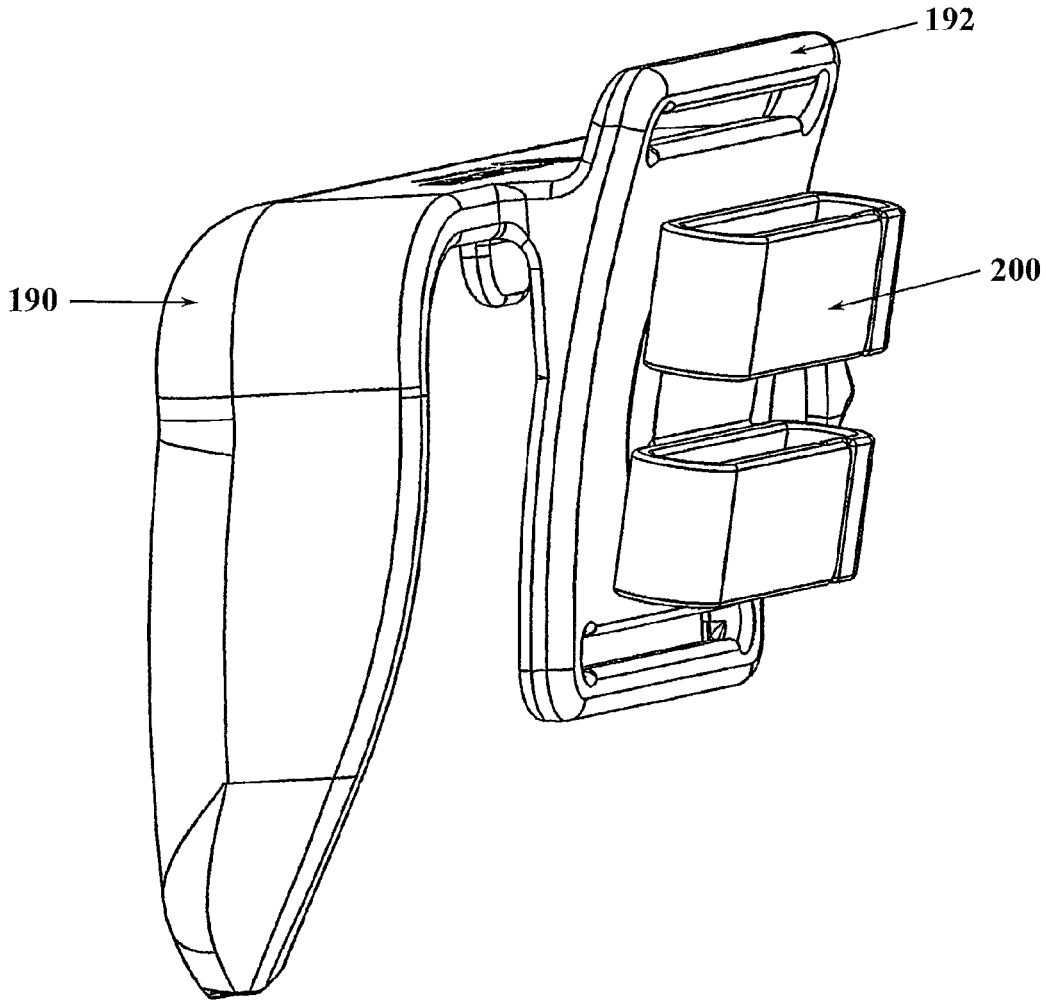
FIG. 21 is a front perspective, left side view of the holster of FIG. 19 with a belt clip.
Figure 22A:
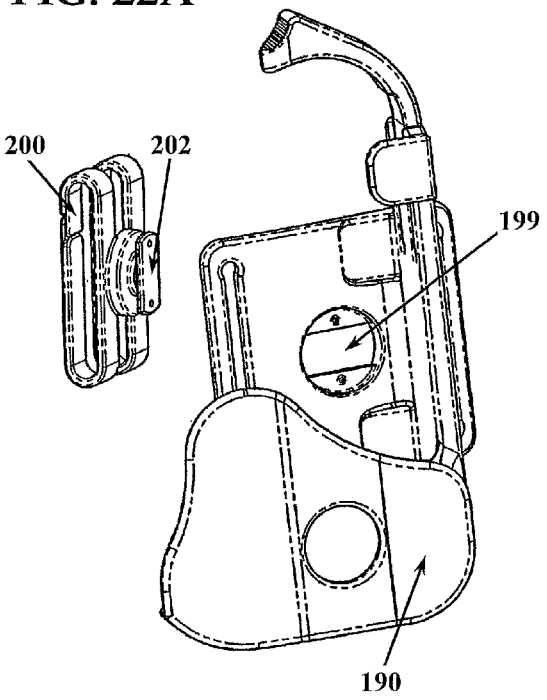
FIG. 22A depicts the holster of FIG. 19 with a belt clip removed.

FIG. 21 is a front perspective, left side view of holster 190 with a belt clip 200. Belt clip 200 is removably attached to holster 190 preferably by compression fit, snap fit, or by rotating an elongated member 202 within slot 199 in holster 190, as depicted in FIGS. 22A,B. FIGS. 22A,B depict holster 190 with belt clip 200 removed, and with belt clip 200 attached, respectively.

Figure 22B:
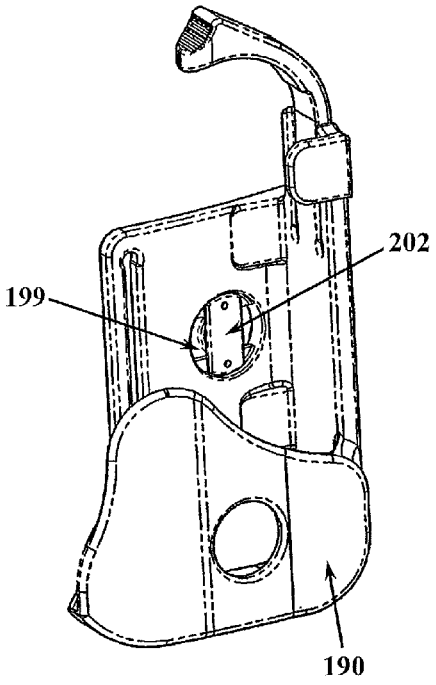
FIG. 22B depicts the holster of FIG. 19 with a belt clip attached by insertion of an elongated member within a slot of the holster.
Figure 23:
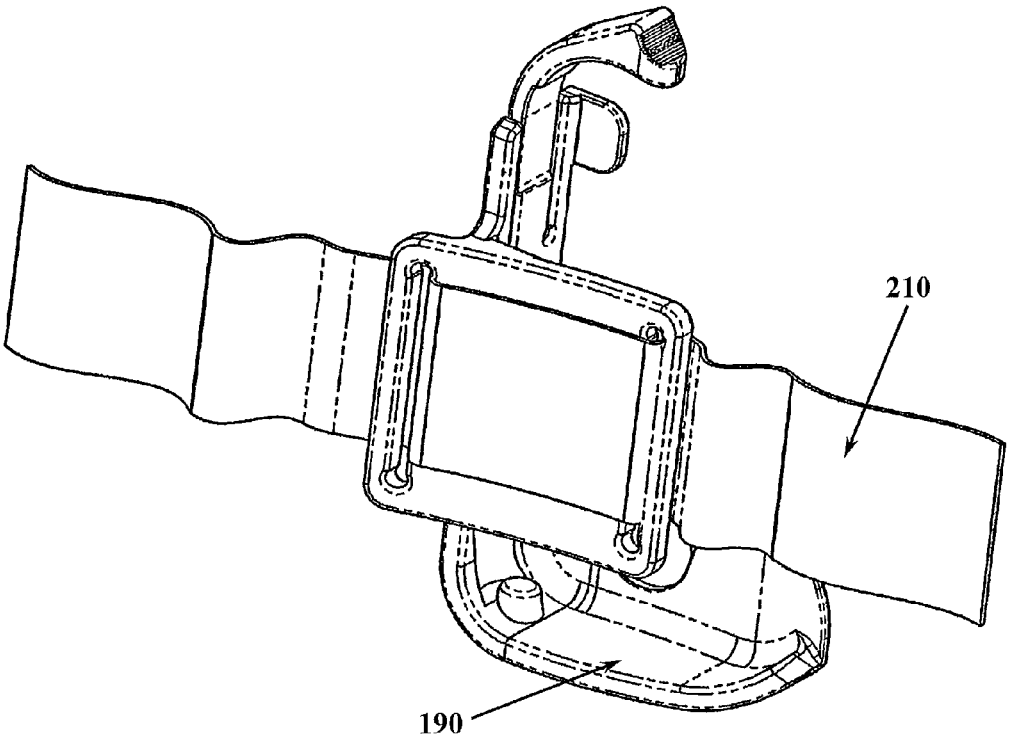
FIG. 23 depicts the back side view of the holster with belt clip of FIG. 22 shown with the belt portion attached.

FIG. 23 is an exemplary embodiment of the back side view of holster 190 with belt clip 200 of FIG. 22 shown with belt portion 210 attached.

Figure 24:
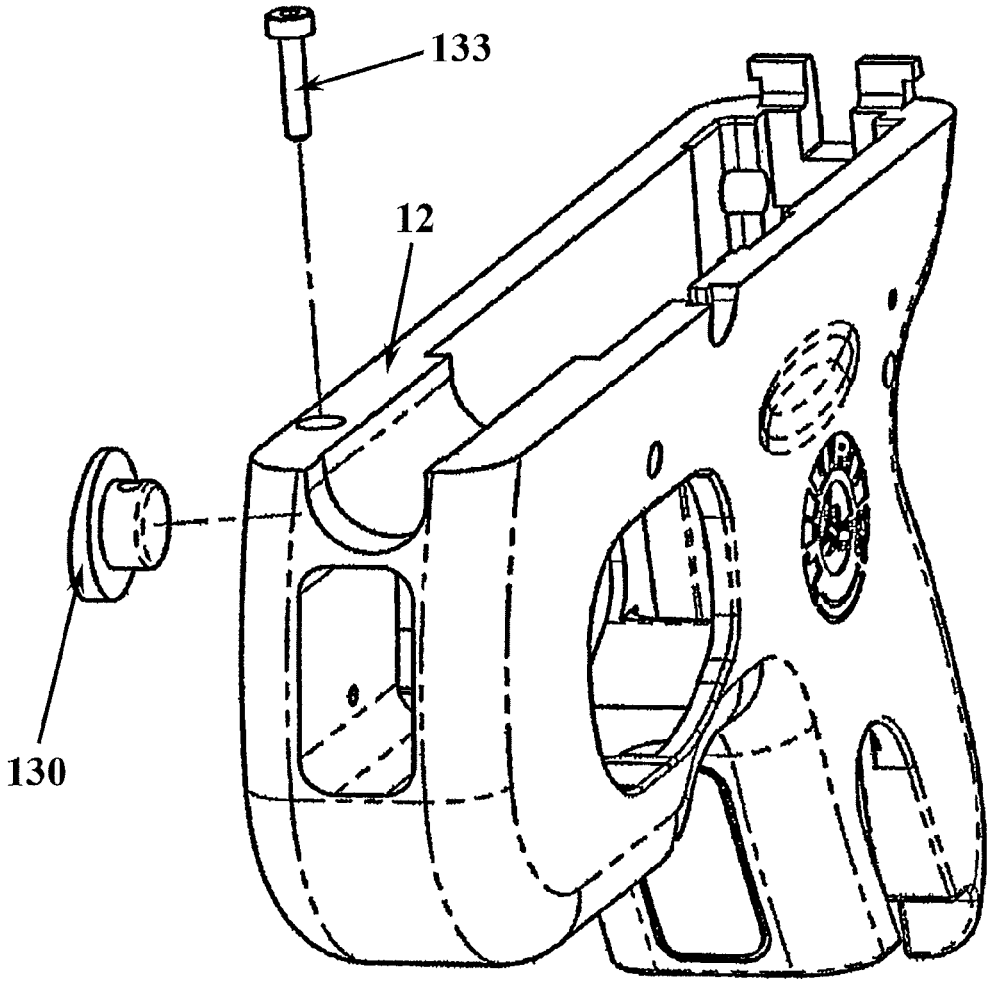
FIG. 24 depicts one method for securing the customized button of FIG. 16 into the housing of the body contoured handgun by an attaching screw or peg.

FIG. 24 depicts one method for securing customized button 130 into housing 12 by attaching screw or peg 133.

Figure 25A:
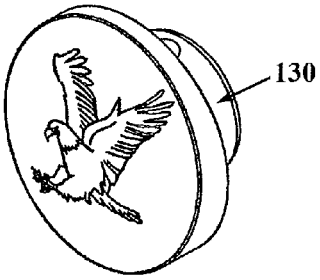
FIG. 25A is a perspective view of a customized button for a curved pistol of the present invention.
Figure 25B:
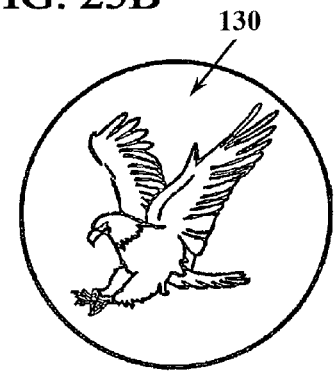
FIG. 25B is a front view of a customized button for a curved pistol of the present invention.
Figure 25C:
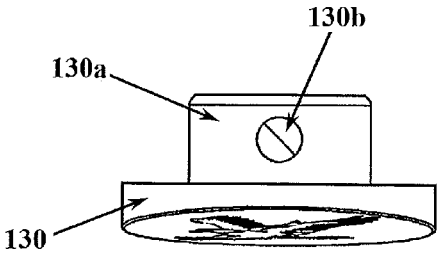
FIG. 25C is a top view of a customized button for a curved pistol of the present invention.
Figure 25D:
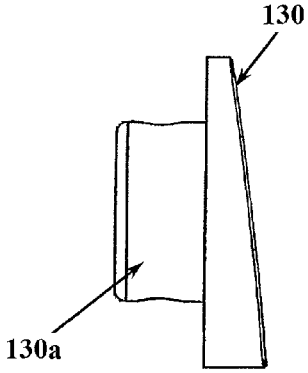
FIG. 25D is a side view of a customized button for a curved pistol of the present invention.

FIG. 25A is a perspective view of an exemplary customized button 130 for a curved pistol of the present invention. FIG. 25B depicts a front view of exemplary customized button 130. FIG. 25C is a top view of customized button 130, depicting a back portion 130*a* having an aperture 130*b* for inserting screw or peg 133*a* curved pistol of the present invention. FIG. 25D is a side view of customized button 130 depicting a partially indented face angled for matching the curvature of the housing surface.

Figure 26:
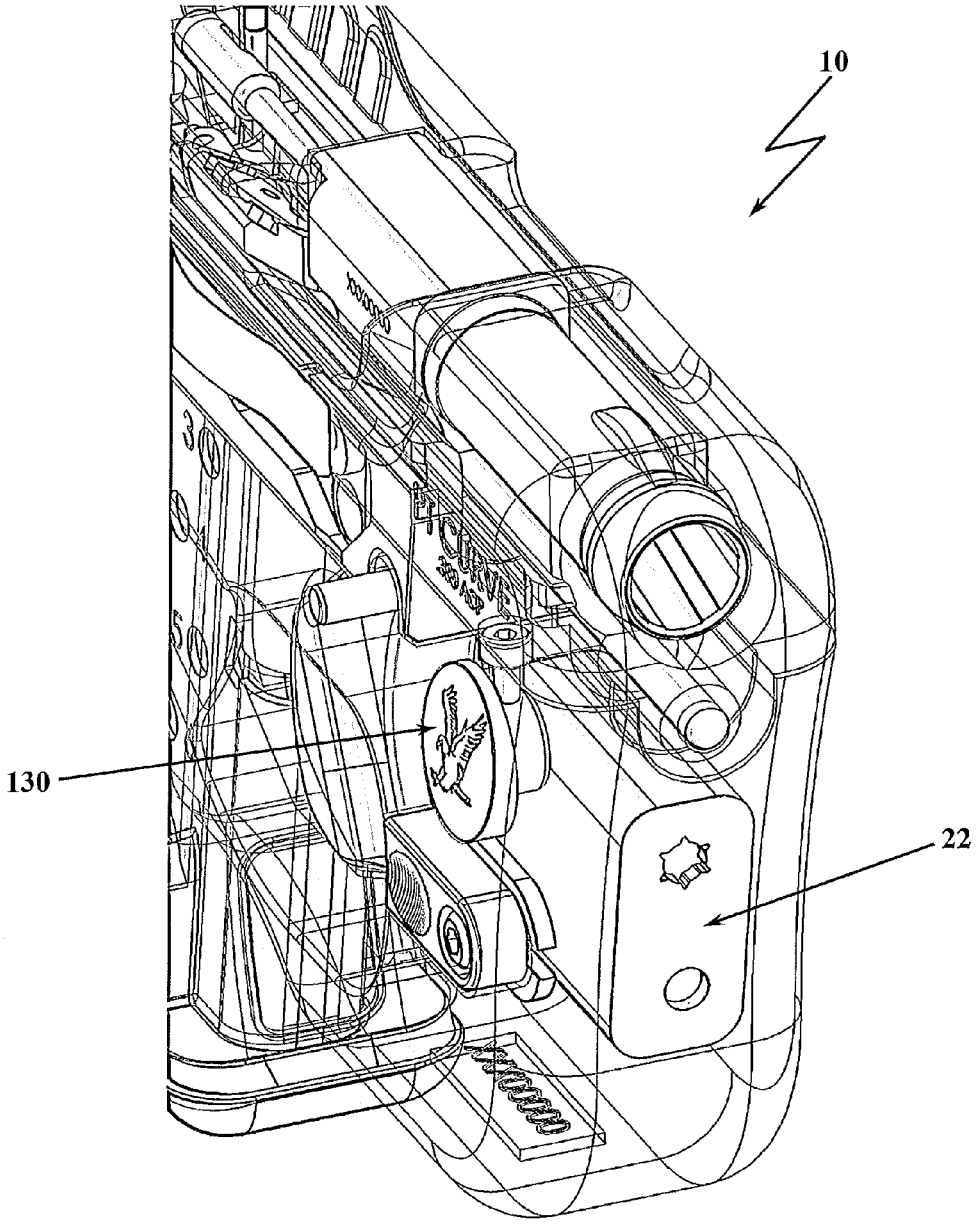
FIG. 26 is a transparent isometric front view of the body contoured handgun of the present invention depicting a client customized button and a laser/light module.
Figure 27:
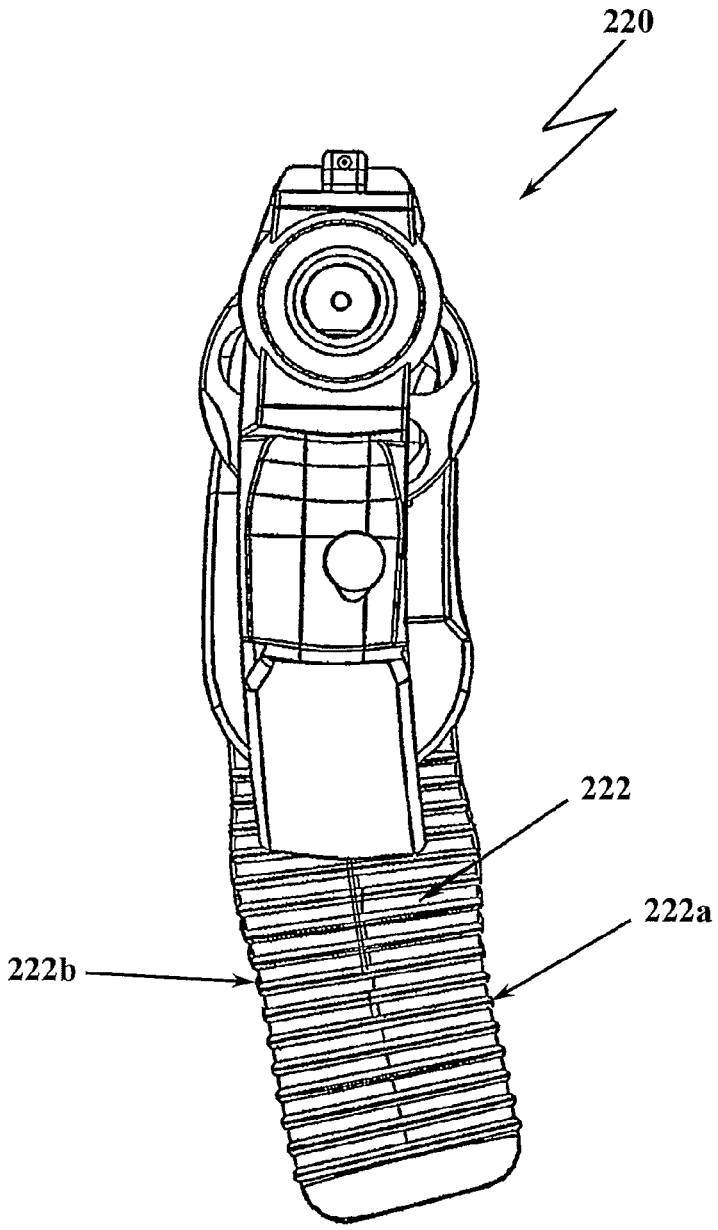
FIG. 27 is a front view of a curved revolver of the present invention.
Figure 28:
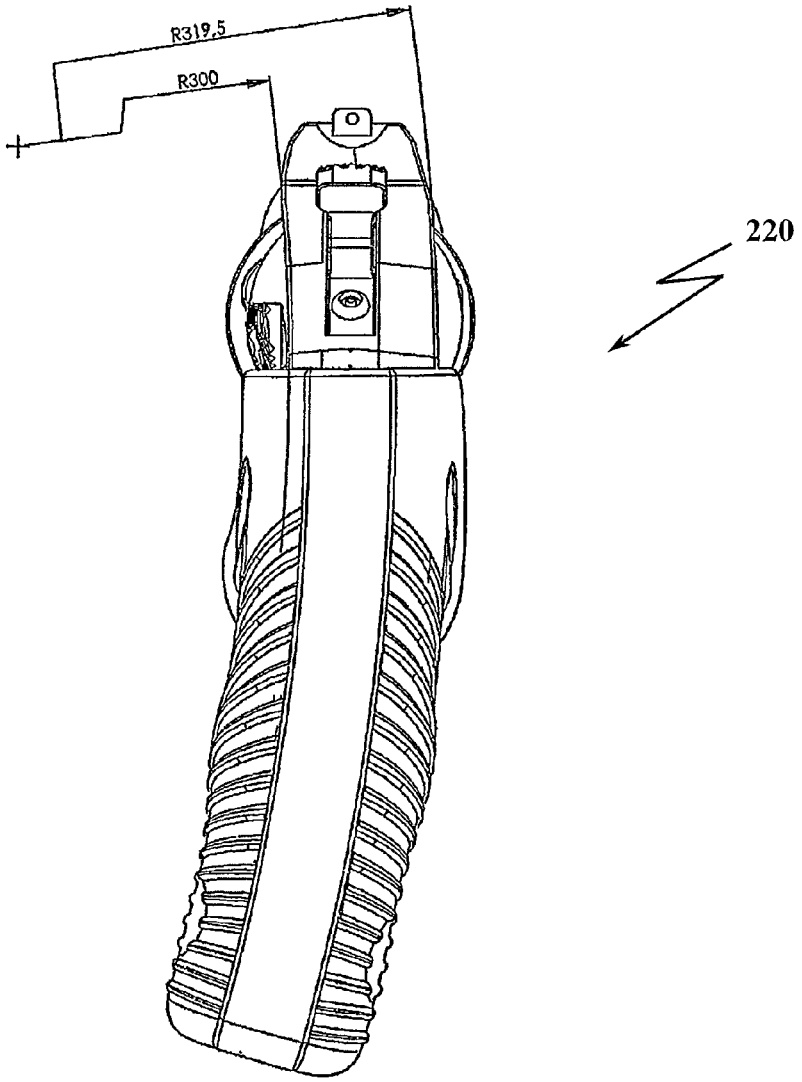
FIG. 28 depicts the rear view of the curved revolver of FIG. 27 with preferred curvature radii shown.
Figure 29A:
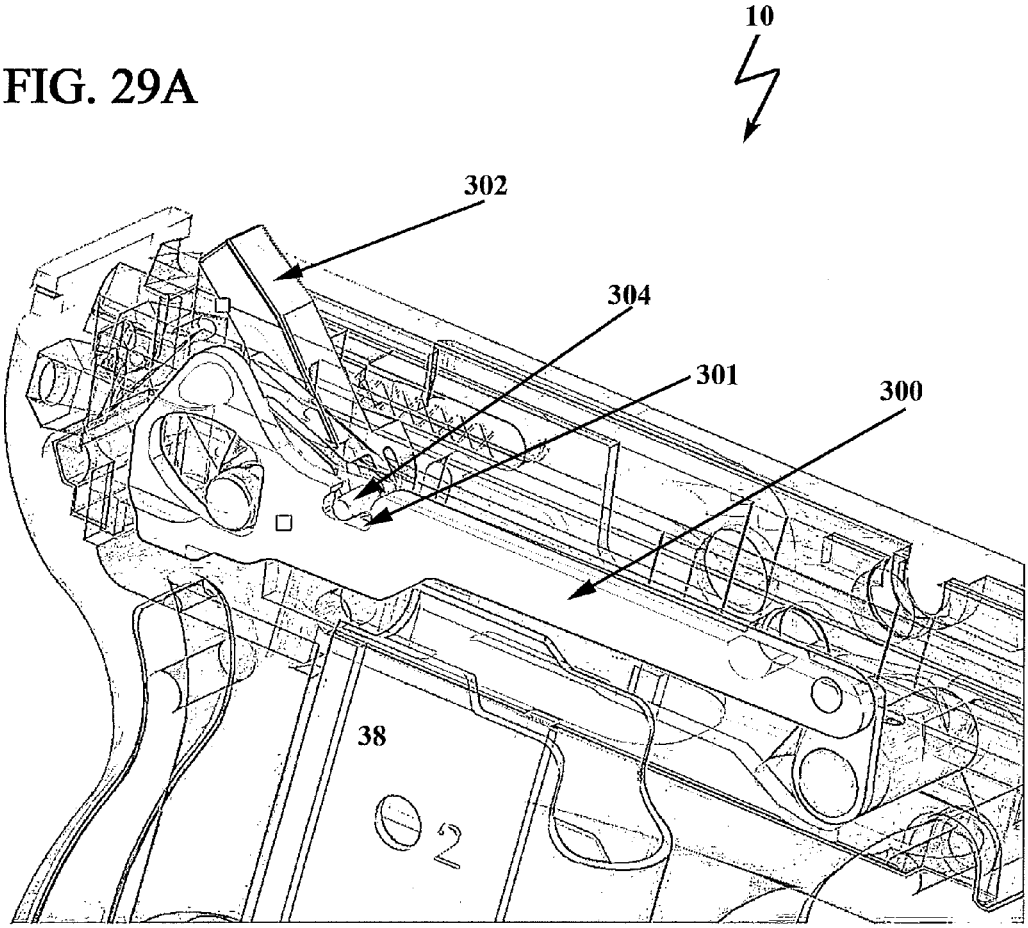
FIG. 29A depicts a perspective sectional view of the curved pistol of the present invention showing the components for initiating a magazine disconnect locking function.
Figure 29B:
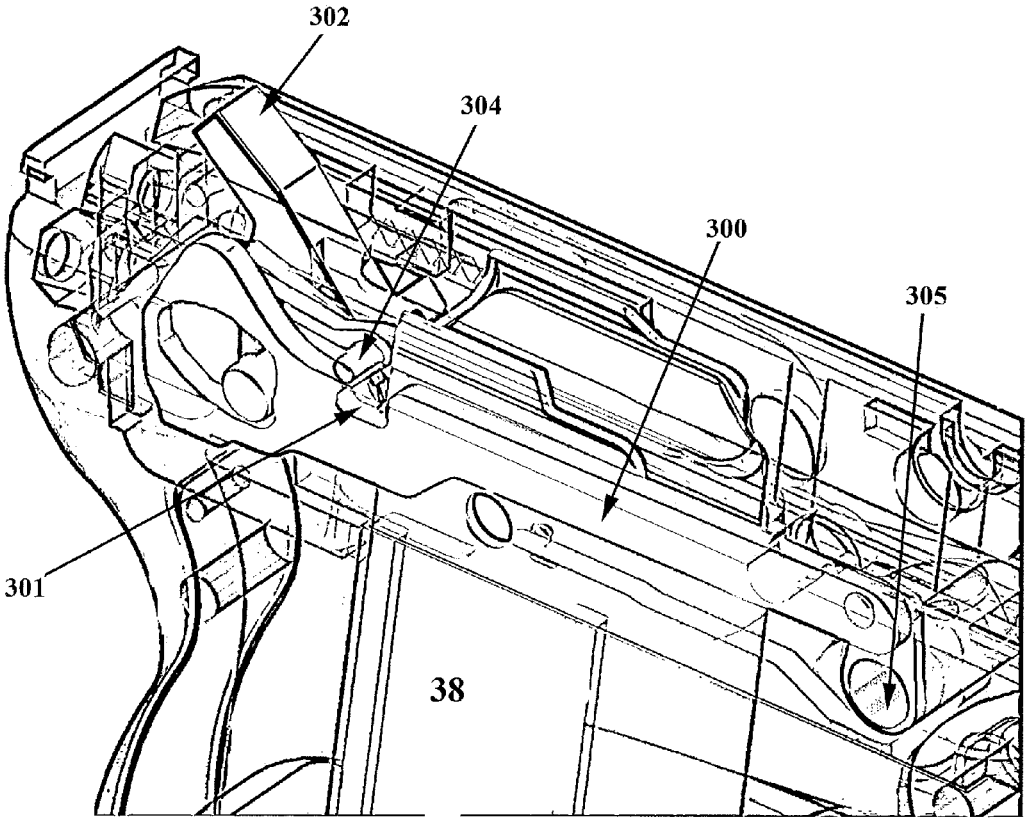
FIG. 29B depicts a perspective sectional view of the curved pistol of the present invention performing a magazine connect unlocking function.

FIG. 26 is a transparent isometric front view of the body contoured handgun 10 of the present invention depicting customized button 130 and laser/light module 22 inserted.

While the present invention has been particularly described, in conjunction with specific preferred embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A handgun having a forward muzzle end and an opposing rear end, said handgun comprising a housing having an exterior surface with left and right sides defined with respect to a vertical plane containing a longitudinal axis of said handgun when said handgun is held upright, and a housing interior enclosed by said housing exterior surface left and right sides, said housing including an intermediate portion, a grip, and a top portion, said intermediate portion adjacent said grip, said top portion, and adjacent to and extending above a trigger guard, and extending from the forward muzzle end to the rear end, said top portion adjacent said intermediate portion, wherein said exterior surface of one side of said housing, left or right, includes substantially a side surface of the grip and a side surface of the intermediate portion, and is substantially curved concave inwards with respect to said vertical plane in a direction towards said housing interior such that said housing is contoured to a person's body when said handgun is carried on said person, and wherein said concave exterior surface is a substantially arcuate segment.

2. The handgun of claim 1 wherein said exterior surface of said housing, right or left, which is opposite the exterior surface side substantially curved concave inwards, is substantially curved convex outwards with respect to said vertical plane in a direction extending away from said housing interior.

3. The handgun of claim 1 wherein said housing includes said trigger guard substantially curved concave inwards on the housing exterior surface side substantially curved concave inwards with respect to said vertical plane.

4. The handgun of claim 2 wherein said housing includes said trigger guard substantially curved convex outwards on the housing exterior surface side substantially curved convex outwards with respect to said vertical plane.

5. The handgun of claim 1 wherein said housing exterior surface concave curvature is not extended to said housing top portion or at least a portion of said housing top portion remains substantially parallel with said vertical plane.

6. The handgun of claim 2 wherein said housing exterior surface concave curvature is not extended to said housing top portion, or at least a portion of said housing top portion remains substantially parallel with said vertical plane, and said housing exterior surface convex curvature is not extended to said housing top portion or at least a portion of said housing top portion remains substantially parallel with said vertical plane.

7. The handgun of claim 1 wherein said handgun comprises a pistol.

8. The handgun of claim 2 wherein said handgun comprises a pistol.

9. The handgun of claim 7 including a slide, said slide having left and right sides approximately parallel to said vertical plane, said slide in slideable communication with said housing top portion.

10. The handgun of claim 7 including a slide, said slide having left and right sides such that said housing exterior surface concave curvature is extended to at least a portion of said slide left or right side adjacent said housing exterior surface on the side of said housing substantially curved concave inwards.

11. The handgun of claim 8 including a slide, said slide having left and right sides approximately parallel with respect to said vertical plane, said slide in slideable communication with said housing top portion.

12. The handgun of claim 8 including a slide, said slide having left and right sides such that said housing exterior surface concave curvature is extended to at least a portion of one side of said slide adjacent said housing exterior surface on the side of said housing substantially curved concave inwards, and said housing exterior surface convex curvature is extended to at least a portion of an other side of said slide adjacent said housing exterior surface on the side of said housing substantially curved convex outwards.

13. A body contoured handgun having a forward muzzle end and an opposing rear end, said handgun comprising a housing having an exterior surface with first and second lateral sides defined with respect to a vertical plane containing a longitudinal axis of said handgun when said handgun is held upright, and a housing interior enclosed by said first and second sides, said housing including:

an intermediate portion, a grip, and a top portion, said intermediate portion adjacent said grip, said top portion, and extending above a trigger guard, and extending from the forward muzzle end to the rear end, said top portion adjacent said intermediate portion, wherein said first lateral side of said exterior surface of said housing includes substantially a side surface of the grip and a side surface of the intermediate portion and is substantially curved concave inwards with respect to said vertical plane in a direction towards said housing interior such that said housing is contoured to a person's body when said handgun is carried on said person, and wherein said concave exterior surface is a substantially arcuate segment, and said second lateral side of said exterior surface of said housing is substantially curved convex outwards with respect to said vertical plane in a direction extending away from said housing interior.

14. The body contoured handgun of claim 13 including a slide, said slide having left and right sides approximately parallel with respect to said vertical plane, said in slideable communication with said housing top portion.

15. The body contoured handgun of claim 13 wherein said housing includes a cavity for encasing a sighting module.

16. The body contoured handgun of claim 15 wherein said cavity includes a side aperture to receive an activation switch of said sighting module.

17. The body contoured handgun of claim 15 wherein said sighting module includes a laser component, a light component, or both.

18. The body contoured handgun of claim 13 including a magazine having a contoured magazine clip, said magazine clip having contoured sides approximately matching convex and concave curvatures of said housing exterior surface first and second sides such that said convex and concave curvatures are substantially retained when said magazine is secured to said housing.

19. The body contoured handgun of claim 18 wherein said magazine clip includes a resilient, compression activated member for releasably securing said magazine to said housing grip portion.

20. The body contoured handgun of claim 13 including a magazine lock for prohibiting trigger activation when a magazine is removed from said handgun or only partially inserted within said handgun.

21. The body contoured handgun of claim 20 wherein said magazine lock includes a trigger rod in mechanical communication at a first end with a trigger, and having a notch proximate a second end for receiving a cam lever when said magazine is removed from said handgun or only partially removed from said handgun, said cam lever blocking translational movement of said trigger rod.

22. The body contoured handgun of claim 21 wherein said cam lever is in mechanical communication with said magazine and is removed from said trigger rod notch when said magazine is fully inserted within said handgun, allowing said trigger rod full translational movement.

23. The body contoured handgun of claim 13 including a bullet chamber for receiving a bullet, and a chamber load indicator responsive to said bullet loaded within said chamber.

24. The body contoured handgun of claim 23 wherein said chamber load indicator comprises a pivotable member responsive to said bullet loaded within said chamber, such that said chamber load indicator pivots when said bullet is loaded within said chamber, and a portion of said chamber load indicator otherwise unseen in a rest position when a bullet is not in said chamber, is visibly exposed when said bullet is loaded within said chamber.

25. The body contoured handgun of claim 13 including shaped alignment marks embedded within or inscribed upon a backside of a slide of said handgun to assist a user sighting said handgun.

26. The body contoured handgun of claim 13 including an index finger hold formed within said housing exterior surface.

27. The body contoured handgun of claim 26 wherein said index finger hold includes a cavity or indentation for receiving a customized button.

28. The body contoured handgun of claim 27 wherein said customized button includes a contoured surface for forming an indentation for said index finger.

29. The body contoured handgun of claim 13 including an elongated indentation within said housing exterior surface for use as a thumb rest.

* * * * *